US011351579B2

(12) United States Patent
Ponomarev

(10) Patent No.: US 11,351,579 B2
(45) Date of Patent: Jun. 7, 2022

(54) SYSTEM AND METHOD FOR SURFACE CLEANING

(71) Applicant: The Boeing Company, Chicago, IL (US)

(72) Inventor: Sergey G. Ponomarev, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/421,684

(22) Filed: May 24, 2019

(65) Prior Publication Data

US 2019/0275566 A1 Sep. 12, 2019

Related U.S. Application Data

(62) Division of application No. 14/187,865, filed on Feb. 24, 2014, now Pat. No. 10,343,193.

(51) Int. Cl.

| | |
|---|---|
| ***B08B 3/12*** | (2006.01) |
| ***B08B 7/02*** | (2006.01) |
| ***B08B 5/02*** | (2006.01) |
| ***B24C 5/00*** | (2006.01) |
| ***B08B 3/02*** | (2006.01) |
| ***B08B 5/04*** | (2006.01) |
| ***B08B 7/04*** | (2006.01) |

(52) U.S. Cl.

CPC ..... *B08B 3/12* (2013.01); *B08B 3/02* (2013.01); *B08B 5/02* (2013.01); *B08B 5/04* (2013.01); *B08B 7/028* (2013.01); *B08B 7/04* (2013.01); *B24C 5/005* (2013.01); *B08B 2203/0288* (2013.01); *B08B 2230/01* (2013.01)

(58) Field of Classification Search

CPC ..... B08B 3/12; B08B 7/026; B08B 7/028; B08B 5/04; B08B 2203/01; B08B 2230/0288; B24C 5/005

See application file for complete search history.

(56) References Cited

U.S. PATENT DOCUMENTS

| | | | |
|---|---|---|---|
| 1,627,961 | A | 5/1927 | Farley |
| 2,164,924 | A | 7/1939 | Hull |
| 2,497,435 | A | 2/1950 | Branneman |
| 3,439,374 | A | 4/1969 | Wisdom |
| 3,934,526 | A | 1/1976 | Damast et al. |
| 4,069,541 | A | 1/1978 | Williams et al. |
| 4,099,420 | A | 7/1978 | Stouffer et al. |
| 4,100,926 | A | 7/1978 | Heim |

(Continued)

FOREIGN PATENT DOCUMENTS

| | | | |
|---|---|---|---|
| CN | 2801056 | Y | 8/2006 |
| CN | 102197462 | A | 9/2011 |

(Continued)

OTHER PUBLICATIONS

JP2009095720—Machine Translation (Year: 2009).*

(Continued)

*Primary Examiner* — Marc Lorenzi

(74) *Attorney, Agent, or Firm* — Walters & Wasylyna LLC

(57) ABSTRACT

A method for cleaning an object includes steps of delivering a cleaning medium to a surface of the object, delivering ultrasonic waves to the object to atomize the cleaning medium, and applying a vacuum airflow to collect atomized cleaning medium.

20 Claims, 18 Drawing Sheets

(56) References Cited

U.S. PATENT DOCUMENTS

| | | | |
|---|---|---|---|
| 4,286,470 | A | 9/1981 | Lynnworth |
| 4,308,547 | A | 12/1981 | Lovelady et al. |
| 4,612,018 | A | 9/1986 | Tsuboi et al. |
| 4,674,334 | A | 6/1987 | Chimenti et al. |
| 4,697,195 | A | 9/1987 | Quate et al. |
| 4,890,567 | A | 1/1990 | Caduff |
| 4,894,806 | A | 1/1990 | Jen et al. |
| 5,228,007 | A | 7/1993 | Murakami et al. |
| 5,251,487 | A | 10/1993 | Marshall |
| 5,284,148 | A | 2/1994 | Dias et al. |
| 5,287,331 | A | 2/1994 | Schindel et al. |
| 5,299,175 | A | 3/1994 | Gallego-Juarez et al. |
| 5,502,872 | A | 4/1996 | Chae et al. |
| 5,515,728 | A | 5/1996 | Casarcia et al. |
| 5,531,861 | A | 7/1996 | Yu et al. |
| 5,613,271 | A | 3/1997 | Thomas |
| 5,890,567 | A | 4/1999 | Pete et al. |
| 5,975,098 | A | 11/1999 | Yoshitani et al. |
| 6,016,351 | A | 1/2000 | Raida et al. |
| 6,029,518 | A | 2/2000 | Oeftering |
| 6,137,019 | A | 10/2000 | Gruter et al. |
| 6,186,004 | B1 | 2/2001 | Kaduchak et al. |
| 6,217,530 | B1 | 4/2001 | Martin et al. |
| 6,230,568 | B1 | 5/2001 | Winston et al. |
| 6,269,527 | B1 | 8/2001 | Nelson |
| 6,311,365 | B1 | 11/2001 | Dornier |
| 6,556,687 | B1 | 4/2003 | Manabe |
| 6,577,738 | B2 | 6/2003 | Norris et al. |
| 6,644,637 | B1 | 11/2003 | Shen et al. |
| 6,662,812 | B1 | 12/2003 | Hertz et al. |
| 6,752,541 | B1 | 6/2004 | Dykyj |
| 6,808,143 | B2 | 10/2004 | Munk et al. |
| 6,810,807 | B2 | 11/2004 | Hebert |
| 7,302,851 | B2 | 12/2007 | Czerw et al. |
| 7,745,521 | B2 | 6/2010 | Schneider et al. |
| 7,759,842 | B2 | 7/2010 | Song et al. |
| 7,762,118 | B2 | 7/2010 | Buchanan |
| 7,773,761 | B2 | 8/2010 | Sun et al. |
| 7,878,750 | B2 | 2/2011 | Zhou et al. |
| 7,963,165 | B2 | 6/2011 | Sinha |
| 8,027,488 | B2 | 9/2011 | Pompei |
| 8,037,762 | B2 | 10/2011 | La Rosa Flores et al. |
| 8,119,709 | B2 | 2/2012 | Schneider et al. |
| 8,151,645 | B2 | 4/2012 | Vivek et al. |
| 8,217,554 | B2 | 7/2012 | Royer, Jr. et al. |
| 2005/0195985 | A1 | 9/2005 | Croft |
| 2005/0236012 | A1 | 10/2005 | Josefsson et al. |
| 2006/0107975 | A1 | 5/2006 | Arguelles et al. |
| 2010/0108093 | A1 | 5/2010 | Peng et al. |
| 2012/0111104 | A1 | 5/2012 | Taverner et al. |
| 2012/0143100 | A1 | 6/2012 | Jeong et al. |
| 2013/0031764 | A1 | 2/2013 | Sarh et al. |
| 2013/0104936 | A1 | 5/2013 | Ponomarev |
| 2014/0090670 | A1 | 4/2014 | Ponomarev |
| 2014/0096794 | A1 | 4/2014 | Ponomarev |
| 2015/0239021 | A1 | 8/2015 | Ponomarev |

FOREIGN PATENT DOCUMENTS

| | | | | |
|---|---|---|---|---|
| DE | 102010051668 | | | 5/2012 |
| EP | 0733021 | | | 9/1996 |
| EP | 2500106 | | | 9/2012 |
| JP | H4-133996 | | | 12/1992 |
| JP | H4-504703 | | | 8/1993 |
| JP | 06079245 | A | * | 3/1994 |
| JP | 6-262149 | A | | 9/1994 |
| JP | 2000-43682 | | | 2/2000 |
| JP | 2004-195429 | | | 7/2004 |
| JP | 2008-62162 | | | 3/2008 |
| JP | 2009095720 | A | * | 5/2009 |
| WO | WO 2001/007851 | | | 2/2001 |

OTHER PUBLICATIONS

JPH06262149—Machine Translation (Year: 1993).*
JPH0679245—Machine Translation (Year: 1994).*
Australian Patent Office, Examination Report No. 1, App. No. 2019203263 (dated Oct. 24, 2019).
Australian Patent Office, Examination Report No. 2, App. No. 2019203263 (dated Feb. 3, 2020).
Japan Patent Office, Office Action, with English translation, App. No. 2016-570769 (dated Jul. 2, 2019).
McLaren Is Using Fighter Jet Technology for Wiper-free Windshields.
Icing Prevention by Ultrasonic Nucleation of Supercooled Water Droplets in Front of Subsonic Aircraft, http://www.dtic.mil/dtic/tr/fulltext/u2/a258212.pdf.
Jose L. Palacious et al., Global ultrasonic shear wave anti-icing actuator for helicopter blades, American Helicopter Society 63rd Annual Forum, Virginia Beach, VA, May 1-3, 2007, http://home.comcast.net/~jlp324/Icing/Palacios AHS 2007.pdf.
Benjamin Howard, High speed photography of ultrasonic atomization, http://ultrasoundatomization.com/ultrasonic_atomization_thesis_text.pdf Mostafa Fatemi and James f. Greenleaf, Ultrasound-Stimulated Vibro-Acoustic Spectrography, http://www.sciencemag.org/content/280/5360/82.full.pdf.
Jose Palacios, PhD dissertation, 2008, Design, Fabrication, and Testing of an Ultrasonic De-Icing System for Helicopter Rotor Blades, https://etda.libraries.psu.edu/paper/8199/.
M. Boukra et al., An experimental study of atomization of a liquid film subjected to an external forcing, 11th ICLASS International Conference on Liquid Atomization and Spray Systems VAIL, USA Jul. 26-30, 2009, http://publications.onera.fr/exl-doc/DOC379478_s1.pdf.
Minoru Kurosawa et al., Characteristics of Liquids Atomization Using Surface Acoustic Wave, Transducers 97, Jun. 16-19, Chicago USA, pp. 801-804, http://www.kurosawa.ip.titech.ac.jp/publications/international.conf/trans97mk.pdf.
Gonzales et al., Application of high intensity air-borne ultrasound for debubbling liquid coating layers, Ultrasonics, 44, 2006, e529-e532, http://dx.doi.org/10.1016/j.ultras.2006.05.118.
Darren Bates & Joanne Bates, Outline of potential applications for high powered ultrasound in recycling, http://infohouse.p2ric.org/ref/22/21796.pdf.
J.A. Gallego-Juarez et al., Power ultrasonic transducers with extensive radiators for industrial processing, Ultrasonic Sonochemistry, 17, 2010, pp. 953-996,4 http://www.ncbi.nih.gov/pubmed/20022545.
Juan A. Gallego-Juarez, High-power ultrasonic processing: recent developments and prospective advances, Physics Procedia, 3, 2010, pp. 35-47, http://dx.doi.org/10.1016/j.phpro.2010.01.006.
Juan A. Gallego-Juarez et al., Sonoprocessing of fluids for environmental and industrial application, Proceedings of 20th International Congress on Acoustics, ICA 2010, Aug. 23-27, 2010, Sydney, Australia, http://www.acoustics.asn.au/conferenceproceedings/ICA2010/cdrom-ICA2010/papers/p567.pdf.
Eric T. Hauck et al., A surface wave mediator technique for crack detection in green parts, http://www.esm.psu.edu/ultrasonics/pdf%20files/surface%20wave%20mediator%20technique_%20for%20green%20parts.pdf.
Gregory Kaduchak et al., A non-contact technique for evaluation of elastic structures at large stand-off distances: application to classification of fluids in steel vessels, Ultrasonics, vol. 37, Issue 8, 2000, pp. 531-536, http://dx.doi.org/10.1016/S0041-624X(99)00109-2.
Matthew Thomson etl al., Detection of surface cracks in fibre reinforced composites using ultrasonic Rayleigh waves, Sensing Technology (ICST), 2011 Fifth International Conference on, pp. 446-451, http://ieexplore.ieee.org/xpls/abs_all.jsp?arnumber=61370197tag=1.
Intelligent lighting, http://en.wikipedia.org/wiki/Intelligent_lighting.
Sound from ultrasound, http://en.wikipedia.org/wiki/Sound_from_ultrasound.
Acoustic streaming, http://wikibooks.org/wiki/Engineering_Acoustics/Acoustic_streaming.

(56) References Cited

OTHER PUBLICATIONS

Manipulating liquids with acoustic radiation pressure, http://www.grc.nasa.gov/WWW/RT/RT1996/4000/4120o.html.
Woon-Seng Gan et al., A review of parametric acoustic array in air, Applied Acoustic, vol. 73, Issue 12, pp. 1211-1219, http://dx.doi/10.1016/j.apacoust.2012.04.001.
Japan Patent Office, Office Action, App. No. 2019-200769 (dated Jan. 21, 2021).
European Patent Office, "Communication pursuant to Article 94(3) EPC," App. No. 15 705 145.9 (dated Mar. 26, 2021).

* cited by examiner

SYSTEM AND METHOD FOR SURFACE CLEANING

PRIORITY

This application is a divisional of U.S. Ser. No. 14/187,865 filed on Feb. 24, 2014.

FIELD

The present disclosure is generally related to surface cleaning systems and, more particularly, to systems and methods employing a cleaning medium, ultrasonic waves and a means to remove debris from a surface of an object, such as employing vacuum suction and airflow.

BACKGROUND

Besides just aesthetic appearance, cleaning the surfaces of manufactured parts is an essential, and in many applications required, process to prepare the part for further processing, such as applying a new finish or assembling the part into a larger component. Conventional methods for removing contaminants, debris or other contamination from objects or surfaces may depend on many factors, such as the nature of the contamination, the requirements for the cleanliness, the shape and size of the object or surface and the like. Generally, conventional cleaning methods fall into two main categories, namely, chemical cleaning and mechanical cleaning.

Conventional cleaning methods have various limitations, such as inconsistent cleaning quality and certain surfaces (e.g., complex surfaces or interior surfaces) may be difficult to reach or access.

Accordingly, those skilled in the art continue with research and development efforts in the field of surface cleaning of objects.

SUMMARY

In one aspect, the disclosed system for cleaning an object may include a cleaning medium dispenser configured to deliver a cleaning medium to the surface, wherein the cleaning medium dislodges and captures debris from the surface, an ultrasonic device configured to deliver ultrasonic waves to the object, wherein the ultrasonic waves atomize the cleaning medium and captured debris from the surface, and a vacuum configured to provide a vacuum airflow, wherein the vacuum airflow collects atomized cleaning medium and captured debris.

In another aspect, disclosed is a method for cleaning an object, the method may include the steps of: (1) delivering a cleaning medium to the surface; (2) delivering ultrasonic waves to the object to atomize the cleaning medium; and (3) applying a vacuum airflow to collect atomized cleaning medium.

In another aspect, disclosed is a method for cleaning an object, the method may include the steps of: (1) delivering a cleaning medium that is in a vaporized form to the surface; (2) dislodging debris from the surface with the cleaning medium that is in the vaporized form; (3) condensing the cleaning medium on the surface; (4) capturing the debris that is dislodged from the surface in the cleaning medium that is in a condensed form on the surface; (5) delivering ultrasonic waves to the object and the cleaning medium that is in the condensed form; and (6) atomizing the cleaning medium that is in the condensed form and that contains the debris that is captured.

Other aspects of the disclosed system and method will become apparent from the following detailed description, the accompanying drawings and the appended claims.

DETAILED DESCRIPTION

Figure 1:
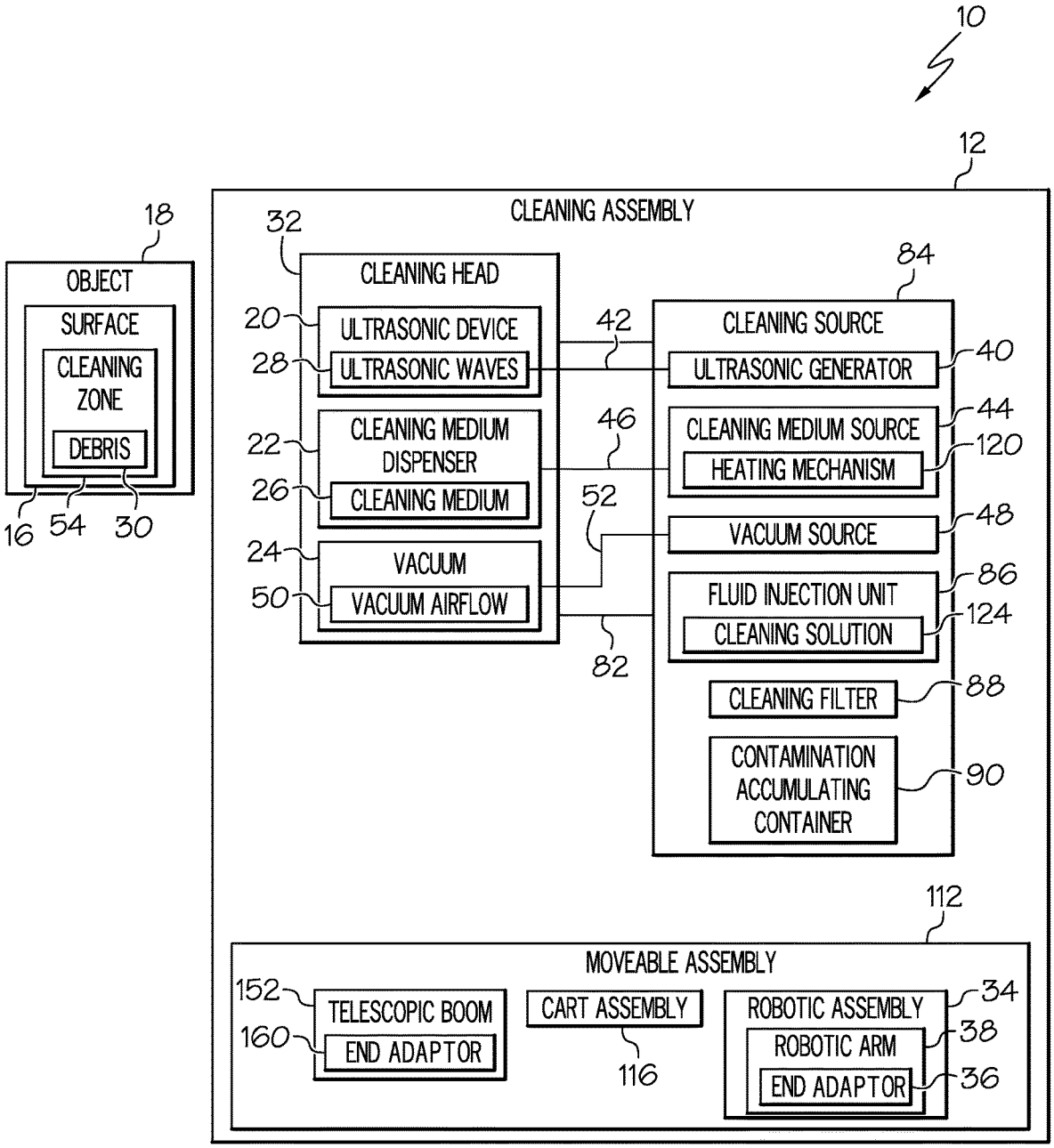
FIG. 1 is a block diagram of one aspect of the disclosed system for surface cleaning.

The following detailed description refers to the accompanying drawings, which illustrate specific aspects of the disclosure. Other aspects having different structures and operations do not depart from the scope of the present disclosure. Like reference numerals may refer to the same element or component in the different drawings.

Referring to FIG. 1, one aspect of the disclosed system, generally designated 10, for surface cleaning of an object may include a cleaning assembly 12 utilized for cleaning one or more surfaces 16 of one or more objects 18, such as during fabrication, assembly and/or maintenance of the object 18. For example, the object 18 may include any manufactured part, component, assembly or sub-assembly having a large and/or complex surface 16, including, but not limited to, complex three-dimensional objects 18 and/or large two-dimensional objects 18, such as an aircraft component (e.g., an airplane wing).

The cleaning assembly 12 may include at least one ultrasonic device 20, at least one cleaning medium dispenser 22 and at least one vacuum 24. The cleaning medium dispenser 22 may deliver a cleaning medium 26 to the surface 16 of the object 18. The ultrasonic device 20 may deliver ultrasonic waves 28 to the object 18 to generate ultrasonic vibrations within (e.g., throughout at least a portion of) the object 18 and/or on the surface 16 of the object to atomize the cleaning medium 26. The vacuum 24 may remove the atomized cleaning medium 26 along with any debris 30 collected by the cleaning medium 26 from the surface 16 of the object 18.

As used herein, debris 30 may include any contaminant, substance and/or other unwanted constituent material disposed on the surface 16 of the object 18. Debris 30 may include any solid, semi-solid, liquid and/or semi-liquid material of any type, without limitation.

The ultrasonic device 20, the cleaning medium dispenser 22 and the vacuum 24 may be mounted to a cleaning head 32. The cleaning head 32 may deliver cleaning medium 26 (e.g., from the cleaning medium dispenser 22), ultrasonic waves 28 (e.g., from the ultrasonic device 20) and vacuum airflow 50 (e.g., from the vacuum 24) directly to a cleaning zone 54 on the surface 16 of the object 18.

An ultrasonic generator 40 may be coupled to the cleaning head 32. The ultrasonic generator 40 (e.g., an ultrasonic power amplifier and function generator) may supply energy to the ultrasonic device 20. The ultrasonic supply line 42 (e.g., a flexible acoustic waveguide) may couple the ultrasonic generator 40 to the cleaning head 32 such that ultrasonic waves 28 may be applied from the ultrasonic devices 20 to the surface 16 of the object 18 (e.g., about the cleaning zone 54).

The cleaning medium source 44 may be fluidly coupled to the cleaning head 32. The cleaning medium source 44 may supply the cleaning medium 26 to the cleaning medium dispenser 22. The cleaning medium supply line 46 may fluidly couple the cleaning medium source 44 to the cleaning head 32 such that cleaning medium 26 may be provided from the cleaning medium dispenser 22 within the vacuum chamber 98 (FIG. 4) and/or to the surface 16 of the object 18 (e.g., about the cleaning zone 54).

The vacuum source 48 may be fluidly coupled to the cleaning head 32. The vacuum source 48 may supply a vacuum airflow 50 (e.g., vacuum suction) to the vacuum 24. The vacuum supply line 52 may fluidly couple the vacuum source 48 to the cleaning head 32 such that vacuum suctioning (e.g., vacuum airflow 50) may be applied from the vacuum 24 within the vacuum chamber 98 and/or to the surface 16 of the object 18 (e.g., about the cleaning zone 54).

The disclosed system 10 may be incorporated into a movable assembly 112. The object 18 (e.g., one or more surfaces 16 of the object 18) may be cleaned with the cleaning head 32, which may be moved alongside the object 18 by the movable assembly 112. A position (e.g., location) of the cleaning head 32 with respect to the object 18 (e.g., the surface 16 of the object 18) and a desired distance between the cleaning head 32 and the object 18 may be set and/or maintained by the movable assembly 112.

The cleaning medium 26 may include any suitable substance and/or material that are able to perform the cleaning action in combination with the ultrasonic waves 28 and vacuum airflow 50. The cleaning medium 26 may include any cleaning fluid. The cleaning fluid may include a liquid or a gas. As an example, the cleaning medium 26 may include liquid water (e.g., hot water and/or cold water). As another example, the cleaning medium 26 may include any aqueous solutions (e.g., organic solvents, surfactants, detergents or other chemicals). As another example, the cleaning medium 26 may be steam (e.g., vaporized water). As another example, the cleaning medium 26 may be air (e.g., forced and/or pressurized air). As another example, the cleaning medium 26 may include a blasting media (e.g., solid plastic pellets, sand, gel capsules, liquid CO2, solid CO2, and the like). As yet another example, the cleaning medium 26 may include any combination of cleaning fluids and/or blasting media.

Thus, the removal of debris 30 may be achieved by the combination of the cleaning medium 26, the ultrasonic waves 28 and the vacuum airflow 50 and, therefore, may be completely non-contact. For example, the cleaning medium dispenser 22, the ultrasonic devices 20 and the vacuum 24 may be positioned at a distance (e.g., spaced away) from the object 18 to be cleaned and do not impose any risk of contamination of the surface 16 of the object 18.

In an example implementation, during a cleaning operation, the cleaning medium 26 may form droplets and/or thin films on the surface 16 of the object 18. The debris 30 may be captured, suspended and/or dissolved in the cleaning medium 26. Ultrasonic waves 28 delivered to the surface 16 by the ultrasonic devices 20 may facilitate atomization and/or evaporation of the droplets and/or films and, thus, removal of the debris 30 from the surface 16 by the vacuum 24.

In a particular, non-limiting example, the disclosed system 10 may perform two major types of cleaning operations, a wet cleaning operation or a dry cleaning operation. The wet cleaning operation and the dry cleaning operation may be combined into a unitary cleaning action.

During a wet cleaning operation, the cleaning medium 26 may include wet steam jets (e.g., having at least 5%-6% water) and may form droplets (e.g., water droplets) and/or thin liquid films (e.g., thin films of water) on the surface 16 of the object 18. Optionally, the cleaning medium 26 may include the addition of cleaning solutions. The debris 30 may be dissolved and/or suspended in the cleaning medium 26 (e.g., particles of debris 30 captured within a liquid envelope). Ultrasonic waves 28 delivered to the surface 16 by the ultrasonic devices 20 may facilitate atomization and/or evaporation of the droplets and/or films and, thus, removal of the debris 30 from the surface 16 by the vacuum 24.

Figure 2:
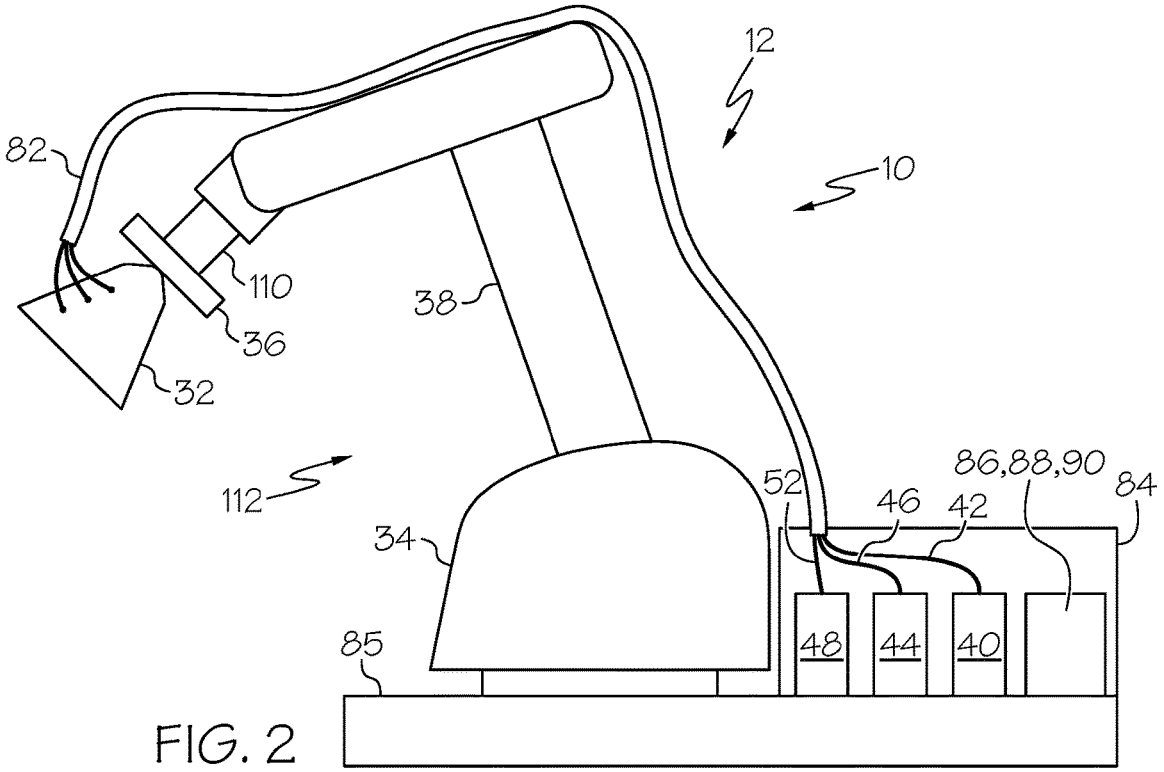
FIG. 2 is a schematic illustration of one implementation of the system of FIG. 1.

During a dry cleaning operation, the cleaning medium 26 may include dry steam jets (e.g., having less than 5%-6% water) and may disintegrate the debris 30 on the surface 16 of the object 18. Ultrasonic waves 28 delivered to the surface 16 by the ultrasonic devices 20 may reduce adhesion of the debris 30 to the surface 16 and, thus, facilitate removal of the debris 30 from the surface 16 by the vacuum 24. Referring to FIG. 2, in one implementation, the movable assembly 112 may be a robotic assembly 34. The robotic assembly 34 may provide for automated or semi-automated cleaning of one or more objects 18. For example, the cleaning head 32 (e.g., including at least one ultrasonic device 20, at least one cleaning medium dispenser 22 and at least one vacuum 24) may be mounted to an end adaptor 36 of a robotic arm 38 of the robotic assembly 34. The end adaptor 36 may be mounted to a movable joint 110 located on an end of the robotic arm 38 of the robotic assembly 34. The movable joint 110 may facilitate positioning of the cleaning head 32 in a desired position and orientation approximating the surface 16 of the object 18 being cleaned.

For example, the movable joint 110 may include a rotary joint for positioning the cleaning head 32 (e.g., positioning of the end adaptor 36) during cleaning of the surface 16 and/or articles protruding from the surface 16 (e.g., fasteners) of the object 18.

A supply line 82 may extend from the cleaning head 32 to a cleaning source 84 that may, for example, be mounted to a base 85 of the robotic assembly 34. The supply line 82 may include an ultrasonic supply line 42, a cleaning medium supply line 46 and a vacuum supply line 52. Similarly, the cleaning source 84 may include an ultrasonic generator 40, a cleaning medium source 44 and a vacuum source 48.

Additionally, a fluid injection unit 86, a cleaning filter 88 and a contamination-accumulating container 90 (e.g., a waste receptacle) may be included in the movable assembly 112 (e.g., in the base 85 of the robotic assembly 34). The fluid injection unit 86 may inject a cleaning solution 124 into the cleaning medium supply line 46 or to the surface 16 of the object 18. The contamination-accumulating container 90 may be coupled to the vacuum supply line 52 for receiving cleaning medium 26 and debris 30 (e.g., water vapor, detergent, chemicals, or other materials) that may be suctioned from the surface 16 of the object 18.

Figure 3:
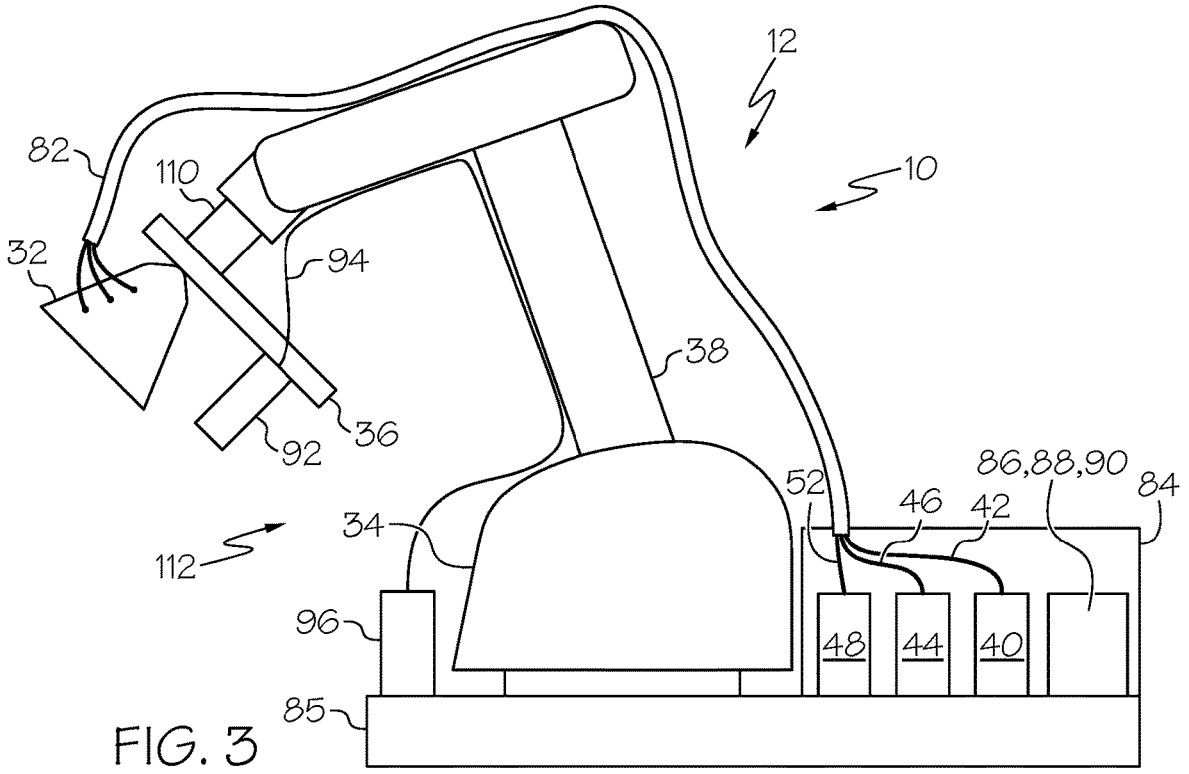
FIG. 3 is a schematic illustration of another implementation of the system of FIG. 1.

Referring to FIG. 3, in another implementation, the robotic assembly 34 may include one or more manufacturing devices 92 mounted, for example, on the end adaptor 36. The manufacturing device 92 may include a device for performing operations on the object 18 (FIG. 1). For example, the manufacturing device 92 may include one or more devices for machining, drilling, painting, sealing, imaging, testing, inspecting, sensing, and other operations on the object 18 (e.g., during fabrication, assembly and/or maintenance). The manufacturing device 92 may be coupled via a supply line 94 to a power supply/material supply unit 96, for example, at the base 85 of the robotic assembly 34 for delivery of materials and/or power to the manufacturing device 92.

The supply line 94 may deliver lubricant, sealant, coating material, or other materials to the manufacturing device 92. The supply line 94 may also deliver electrical power, pressurized air, hydraulic fluid, and other mediums for operating the manufacturing device 92. The cleaning head 32 may be employed in the robotic assembly 34 to perform a cleaning operation on the object 18 prior to or following the performance of one or more manufacturing, inspection, repair, or maintenance operations on the object 18 by one or more of the manufacturing devices 92.

Figure 4:
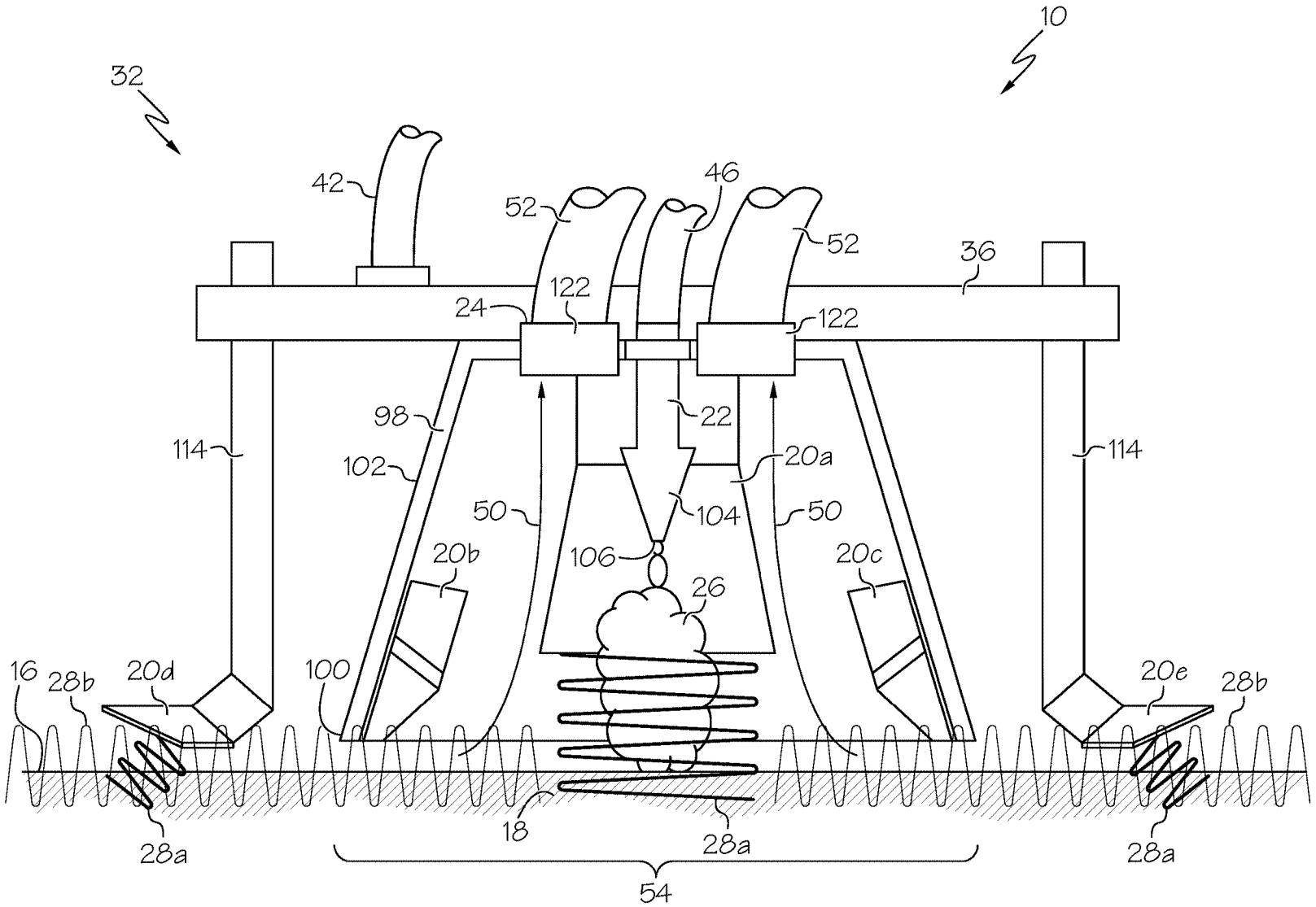
FIG. 4 is a schematic illustration of one implementation of the cleaning head of the system of FIG. 1.

Referring to FIG. 4, in one implementation, the cleaning head 32 may include a vacuum chamber 98 having an open end 100. For example, a plurality of sidewalls 102 may define a partially enclosed vacuum chamber 98 having a rectangular cross-sectional shape. As another example, a continuous sidewall 102 may define a partially enclosed vacuum chamber 98 having an annular cross-sectional shape. The vacuum chamber 98 may be sized and configured according to a given cleaning operation and/or application, such as the size of the object 18, the shape of the object 18 and/or the complexity of the object 18. Similarly, the size of the cleaning zone 54 may be determined by area covered by the cleaning medium 26, the vacuum airflow 50 and ultrasonic waves 28 (e.g., waves 28*a* and 28*b*).

In an example construction, the cleaning head 32 may be removably attached to (e.g., detachable from) the movable assembly 112 (e.g., the end adaptor 36 of the robotic arm 38). In order to facilitate detachment of the cleaning head 32 and replacement of a cleaning head 32 having the same or a different configuration, the cleaning head 32 may include at least one end fitting (not shown). For example, the end fitting may be provided as a quick release mechanism. The quick release mechanism may be provided in any one of a variety of configurations for releasably attaching the cleaning head 32 to the supply line 82 and/or the movable assembly 112 (e.g., the end adaptor 36). The detachable arrangement of the cleaning head 32 may facilitate mounting of any one of a variety of different cleaning heads 32 having different sizes, shapes, and configurations (e.g., quantity and/or configurations of ultrasonic devices 20, cleaning medium dispensers 22 and/or vacuums 24) to correspond to a given cleaning application.

The cleaning head 32 may include a plurality of ultrasonic devices 20 (identified individually as 20*a*, 20*b*, 20*c*, 20*d* and 20*e*). Each ultrasonic device 20 may be an air coupled (e.g., non-contact) ultrasonic transducer (e.g., an actuator and a receiver) that converts energy into ultrasound (e.g., sound waves). For example, the ultrasonic device 20 may be a piezoelectric transducer that converts electrical energy into sound. Piezoelectric crystals may change size when a voltage is applied, thus applying an alternating current ("AC") across the piezoelectric transducer may cause it to oscillate at a very high frequency and produce very high frequency sound waves (e.g., ultrasonic waves 28). The plurality of ultrasonic devices 20 may be configured into an array of ultrasonic devices 20. The array of ultrasonic devices 20 may include a geometry that directs and concentrates the ultrasonic waves 28 onto particular areas (e.g., cleaning zones 54) on the surface 16 of the object 18 to be cleaned.

The high frequency ultrasonic vibrations generated by the ultrasonic waves 28 may atomize or aerosolize the droplets and/or thin films of cleaning medium 26 that are formed on the surface 16 of the object 18. The vacuum 24 may then collect the atomized cleaning medium 26 and debris 30 (e.g., particles of debris 30) within the vacuum airflow 50, which may be deposited in the contamination-accumulating container 90.

In addition, the ultrasonic waves 28 (e.g., focused energy) may promote and/or facilitate evaporation of the cleaning medium 26 from the surface 16 of the object 18 (e.g., about the cleaning zone 54). This evaporation may result from excitation (e.g., at the molecular level) of the cleaning medium 26 on the surface 16 of the object 18. This excitation may cause friction and thus turns the acoustic energy from the ultrasonic waves 28 into heat. This heat may cause the water molecules of the cleaning medium 26 to move apart forming gas.

The ultrasonic waves 28 may be modulated, such that the interaction of the modulated ultrasonic waves 28 with the object 18 and air medium (e.g., air between the ultrasonic devices 20 and the surface 16 of the object 18) generates desired patterns of ultrasonic vibrations. For example, the ultrasonic devices 20 may generate ultrasonic waves 28 having different frequencies and/or amplitudes such that when the ultrasonic waves 28 impinge on the object 18, desired patterns of ultrasonic vibrations may be generated on the surface 16 of the object 18 and in the air medium.

The initial patterns generated by the ultrasonic waves 28 may be complex but eventually, after many reflections and as the ultrasonic waves 28 travel from one boundary to another, a modal pattern may be established at a resonant frequency. There may be many resonant frequencies fairly close together because of the ultrasonic excitation. Removal of the cleaning medium 26 and debris 30 may often occur at a resonant or a non-resonant situation.

Figure 6:
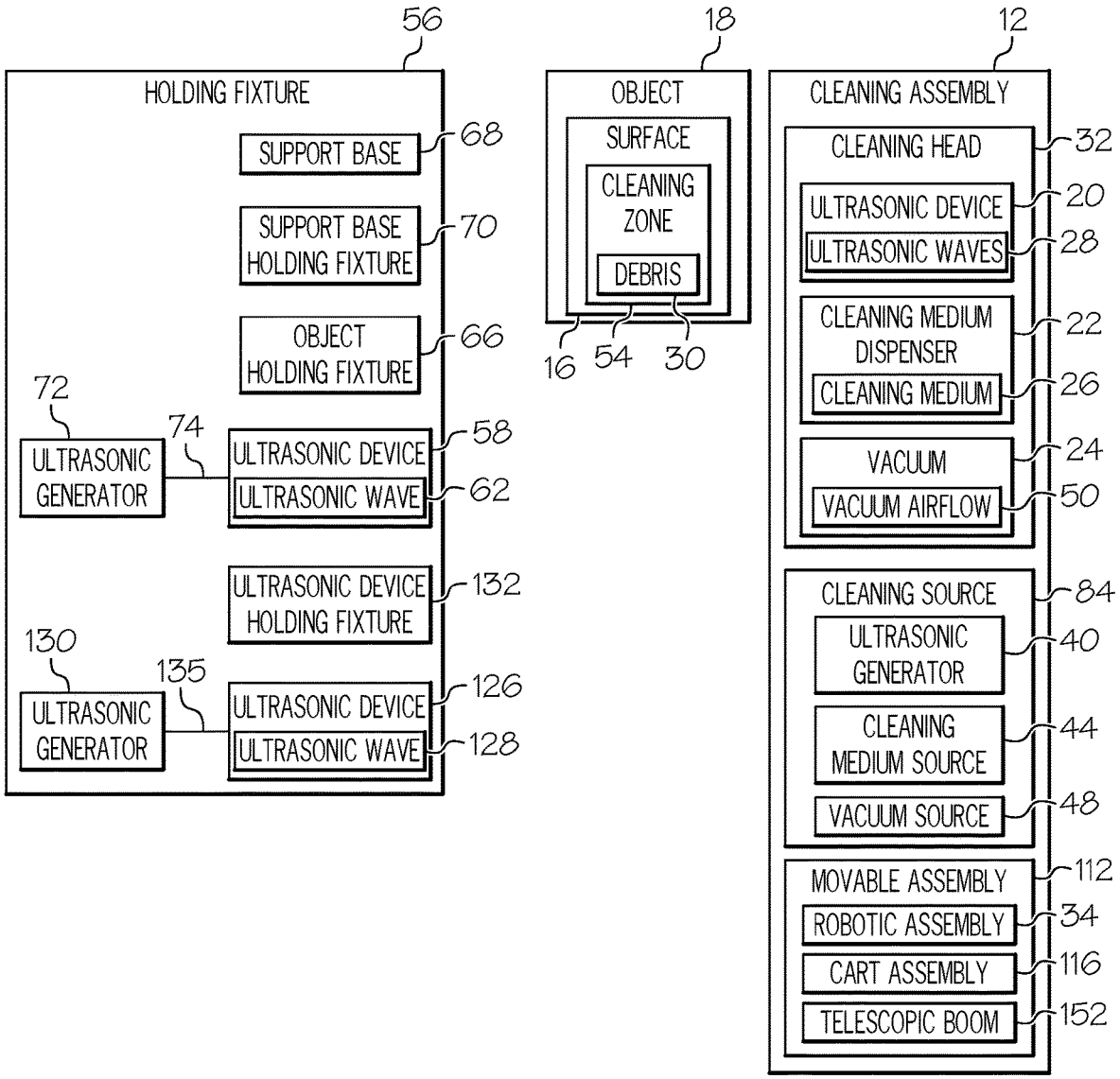
FIG. 6 is a block diagram of another aspect of the disclosed system.

Various types of guided ultrasonic wave modes and stress focal points may be created on the surface 16 of the object 18 at desired locations (e.g., the cleaning zone 54) by placing, activating and tuning the ultrasonic devices 20 to form an acoustically resonating system. The acoustically resonating system may deliver the desired patterns of ultrasonic vibrations to the entire object 18, which, for example, may be fixed with a holding fixture 56 (FIG. 6). The air coupled ultrasonic devices 20, which are located outside the object 18, may create the desired patterns of ultrasonic vibrations directed about the cleaning zone 54. Focusing ultrasonic stresses may be achieved electronically (e.g., tuning the ultrasonic devices 20) and/or mechanically (e.g., positioning the ultrasonic devices 20). Air-coupled, parametric acoustic arrays (e.g., parametric arrays or phased arrays) of ultrasonic devices 20 may be specifically configured to impinge ultrasonic vibrations on complex three-dimensional objects to facilitate atomization of the droplets and thin films of cleaning medium 26 containing the debris 30.

As used herein, a parametric array may include a plurality of ultrasonic devices 20 (e.g., piezoelectric transducers) configured to produce a narrow primary beam of sound (e.g., ultrasonic waves 28). In general, the larger the dimensions of the parametric array, the narrower the beam. As a general, non-limiting example, the parametric array may be driven at two closely spaced ultrasonic frequencies (e.g., $\omega 1$ and $\omega 2$) at high enough amplitudes to produce a difference frequency (e.g., $\omega 2-\omega 1$).

As used herein, a phased array may include a plurality of ultrasonic devices 20 (e.g., piezoelectric transducers) individually connected so that the signals they transmit or receive may be treated separately or combined as desired. For example, multiple ultrasonic devices 20 may be arranged in patterns in a common housing. The patterns may include, but are not limited to, linear, matrix, and/or annular in shape. The ultrasonic devices 20 may be pulsed simultaneously or independently of each other in varying patterns to achieve specific beam characteristics.

As illustrated in FIG. 4, ultrasonic device 20*a*, 20*b* and 20*c* may be located within the vacuum chamber 98. For example, ultrasonic device 20*a* may be positioned at a generally central location within the vacuum chamber 98 and ultrasonic devices 20*b* and 20*c* may be positioned proximate (e.g., at or near) edges of the vacuum chamber 98 (e.g., proximate the open end 100.) Ultrasonic devices 20*d* and 20*e* may be located outside of the vacuum chamber 98. For example, ultrasonic devices 20*d* and 20*e* may be attached to one or more holding fixtures 114. The holding fixture 114 may be attached (e.g., removably attached) to the cleaning head 32 and/or end adaptor 36. Ultrasonic devices 20*d* and 20*e* may be positioned at a fixed location on an associated holding fixture 114 or may be movable (e.g., manually or electromechanically) relative to the associated holding fixture 114.

For example, the plurality of ultrasonic devices 20 (e.g., the array of ultrasonic devices 20) may be tuned and/or positioned to alter wave interference phenomenon in order to create a one or more interference zones or stress focal points (e.g., at the cleaning zones 54) that may be moved around the object 18 as position, frequency and/or wave mode are changed. The cleaning zone 54 may be moved, through user selection, allowing cleaning at specific points on the surface 16 of the object 18.

Specific ultrasonic mode and frequency excitation over a frequency range (e.g., from 1 Hz to 500 MHz) may be provided, wherein frequency tuning over a selected frequency range may be achieved by optimally positioning the ultrasonic devices 20 and/or by modal vibration combinations. How the ultrasonic stresses are focused for effective atomization and/or evaporation of the cleaning medium 26 and debris 30 from the surface 16 of the object 18 may depend on the particular cleaning operation. For example, the type of debris 30, the thickness of the debris 30, the structural geometry of the object 18, environmental conditions and the like may affect the configuration of the ultrasonic devices 20.

As an example, the frequency of one or more of the ultrasonic devices 20 may be tuned to a particular frequency or frequency range depending upon the particle size of the debris 30. As an example, relatively low frequencies (e.g., below approximately 20 kHz) may atomize the cleaning medium 26 into a relatively large mist (e.g., approximately 10 microns and above). Thus, the mist of atomized cleaning medium 26 may capture relatively large particles of debris 30 (e.g., approximately 10 microns and above). As another example, relatively high frequencies (e.g., above approximately 1 MHz) may atomize the cleaning medium 26 into a relatively small mist (e.g., approximately 3 microns and below). Thus, the mist of atomized cleaning medium 26 may capture relatively small particles of debris 30 (e.g., approximately 3 microns and below).

As another example, the frequency of one or more of the ultrasonic devices 20 may be tuned to a particular frequency or frequency range depending upon the size and/or shape of the surface 16 to be cleaned. As an example, large and/or generally flat surfaces may have relatively large particles of debris 30 (e.g., approximately 10 microns and above). Thus, relatively low frequencies (e.g., below approximately 20 kHz) may be used to atomize the cleaning medium 26 and the debris 30 from the surface 16. As another example, small and/or complex surfaces may have relatively small particles of debris 30 (e.g., approximately 3 microns and below). Thus, relatively high frequencies (e.g., above approximately 1 MHz) may be used to atomize the cleaning medium 26 and the debris 30 from the surface 16.

The ultrasonic devices 20 may be configured to generate a variety of different types of ultrasonic waves 28 (FIG. 1) applied to the surface 16 of the object 18, including, but not limited to, longitudinal waves, shear waves, surface waves and/or plate waves. For example, ultrasonic device 20*a* may generate ultrasonic waves 28*a* (e.g., longitudinal and/or shear waves) in the object 18 and ultrasonic devices 20*b*, 20*c*, 20*d* and 20*e* may generate ultrasonic waves 28*b* (e.g., surface and/or plate waves) on the surface 16 of the object 18. As another example, ultrasonic devices 20*a*, 20*b* and 20*c* may generate ultrasonic waves 28*a* (e.g., longitudinal waves and/or shear waves) in the object 18 and ultrasonic devices 20*d* and 20*e* may generate ultrasonic waves 28*b* (e.g., surface waves and/or plate waves) on the surface 16 of the object 18. Those skilled in the art will appreciate that any individual ultrasonic device 20 and/or combination of ultrasonic devices 20 (e.g., arrays of ultrasonic devices 20) may be configured to generate any combination of ultrasonic waves 28 (e.g., longitudinal waves and/or shear waves in the object 18 and/or surface waves and/or plate waves on the surface 16 of the object 18).

Additionally, the ultrasonic devices 20 may also be used for non-destructive inspection of the object 18 and/or structural health monitoring of the object 18. For example, at least two ultrasonic devices 20 (e.g., transmitter and receiver) may be positioned above the surface 16 of the object 18. The positions of the devices 20 may be adjusted relative to each other and relative to and along the surface 16 in order to define the directions of sonic propagation at appropriate angles to generate and detect surface and/or plate waves on the surface 16. The generation and detection of the ultrasonic waves 28 may depend on several factors including, but not limited to, the elastic properties of the material of the surface 16 and the presence of contamination (e.g., debris 30) and water. A reference library of various patterns of the ultrasonic waves 28 generated and detected by the ultrasonic devices 20 on the reference surfaces may be built and used in non-destructive inspection of the conditions (e.g., cleanliness) of the monitored surface 16 of the object 18.

The cleaning medium dispenser 22 may be located within the vacuum chamber 98 at an orientation sufficient to deliver the cleaning medium 26 to the surface 16 of the object 18. The cleaning medium dispenser 22 may include a nozzle 104 fluidly coupled to the cleaning medium supply line 46. The nozzle 104 may include a nozzle outlet 106 configured to discharge the cleaning medium 26 directly into the vacuum chamber 98 and/or on the surface 16 of the object 18 (e.g., within the cleaning zone 54). The cleaning medium 26 (e.g., a water spray or steam cloud) may facilitate the removal of debris 30 (FIG. 1) from one or more surfaces 16 of the object 18.

The cleaning medium dispenser 22 (e.g., the nozzle 104) may be configured to discharge cleaning medium 26 in a manner such that one or more surfaces 16 of the object 18 may be exposed to the cleaning medium 26 for dislodging and removing debris 30 from the surface 16 of the object 18. For example, the nozzle outlet 106 may be configured to discharge cleaning medium 26 along a generally axial direction toward one or more surfaces 16 of the object 18 at the open end 100 of the cleaning head 32. However, the nozzle outlet 106 may be configured to discharge cleaning medium 26 in any one of a variety of directions and/or angles.

Although a single nozzle 104 with a single nozzle outlet 106 is shown, any number of nozzles 104 and/or nozzle outlets 106 in any size and location may be provided. For example, a plurality of nozzles 104 and/or a plurality of nozzle outlets 106 may extend into the vacuum chamber 98 at different locations to provide a more uniform distribution of cleaning medium 26. Further, although the nozzle 104 is illustrated as being fluidly coupled to an end (e.g., opposite the open end 100) of the vacuum chamber 98, one or more nozzles 104 may be included to provide cleaning medium 26 from one or more locations along the sidewalls 102 of the vacuum chamber 98 (e.g., proximate the open end 100).

In an example implementation, the cleaning medium 26 may be water (e.g., hot water), the cleaning medium dispenser 22 may include a nozzle 104 suitable to discharge water (e.g., in the form of a drip, a stream, a spray or a mist), the cleaning medium supply line 46 may be a water supply line, and the cleaning medium source 44 may be a water source (e.g., water tank). Optionally, the cleaning medium source 44 may include a heating mechanism 120 (FIG. 1) to heat the water to a desired cleaning temperature.

In another example implementation, the cleaning medium 26 may be steam (e.g., wet steam and/or dry steam), the cleaning medium dispenser 22 may include a nozzle 104 suitable to discharge steam (e.g., in the form a spray, a mist, or a jet), the cleaning medium supply line 46 may be a steam supply line and the cleaning medium source 44 may be a steam source (e.g., water tank and a heating mechanism 120 (FIG. 1) to generate steam). For example, the cleaning head 32 may be configured such that a steam jet is discharged from the nozzle outlet 106 resulting in the formation of a steam cloud within the vacuum chamber 98 and/or on the surface 16 of the object 18.

The cleaning medium 26 (e.g., steam, hot water, and/or an aqueous cleaning solution) may facilitate the removal of debris 30 (FIG. 1) from one or more surfaces 16 of the object 18. For example, the steam cloud may promote the dislodgement of debris 30 (FIG. 1) from the surface 16 of the object 18 by releasing and breaking up bonds between the debris 30 and the surface 16 of the object 18. The breaking up of the debris 30 may result from a plurality of micro-condensations that may occur when relatively tiny hot water vapor molecules contact the relatively cooler debris 30. The micro-condensations may provide energy to break the bonds within the debris 30 and bonds between the debris 30 and the surface 16 of the object 18. The result of the micro-condensations and the breaking of the bonds may be a plurality of relatively small particles of debris 30 that may become entrained in water suspension (e.g., within a liquid envelope) in the cleaning medium 26 (e.g., the steam cloud).

Additionally, steam may have a relatively low moisture content such as between approximately 2 percent and 10 percent moisture and, more preferably, between approximately 4 percent and 7 percent moisture which may enable the surface 16 of the object 18 to dry relatively quickly. Further, the low moisture content of steam may result in relatively low water usage during cleaning operations.

The flow of cleaning medium 26 into the vacuum chamber 98 and/or to the surface 16 of the object 18 may be provided by the cleaning medium supply line 46. In an example construction, the cleaning medium supply line 46 may extend from the cleaning medium source 44 (e.g., at the base 85 of the robotic assembly 34) (FIG. 2) to the cleaning head 32. Thermal insulation may cover a substantial portion of the cleaning medium supply line 46 to preserve the temperature of the cleaning medium 26 (e.g., steam) within the cleaning medium supply line 46 and as a safety precaution for personnel using the system 10. The flow of cleaning medium 26 from the cleaning medium supply line 46 into the cleaning medium dispenser 22 (e.g., the nozzle 104) may be controlled by a valve (e.g., a steam valve or water valve (not shown)) that may be mounted to the cleaning medium supply line 46 and/or to the cleaning head 32.

The temperature and/or the pressure of the cleaning medium 26 (e.g., water temperature and/or pressure or steam temperature and/or pressure) may be regulated, adjusted and/or otherwise controlled to correspond to a given cleaning operation. For example, the temperature may of the cleaning medium 26 be controlled to provide cleaning medium 26 at a temperature that may avoid heat damage to the material composition of the object 18 and/or the surface 16 being cleaned. Similarly, the pressure of the cleaning medium 26 may be regulated (e.g., by means of the valve) such that cleaning medium 26 may be discharged from the nozzle outlet 106 in a manner that the velocity of the cleaning medium 26 is high enough to contact the surface 16 of the object 18 prior to atomization of the cleaning medium 26 (e.g., by the ultrasonic waves 28) and vacuum suctioning of the cleaning medium 26 and any collected debris 30 into the vacuum 24 (FIG. 1). Control of cleaning medium 26 from the cleaning medium source 44 (FIG. 1) may be preprogrammed, for example, into the movable assembly 112.

The vacuum 24 (FIG. 1) may be fluidly coupled to the vacuum supply line 52 (e.g., a vacuum hose) to provide vacuum suctioning (e.g., vacuum airflow 50) within the vacuum chamber 98 and/or to the surface 16 of the object 18. The corresponding vacuum airflow 50 may be directed to the vacuum source 48 (FIG. 1) through one or more vacuum inlet manifolds 122. The vacuum inlet manifold 122 may be located inside the vacuum chamber 98.

The size, quantity, location, relative position, orientation angle, and distance from the surface 16 of the object 18 may be considered when sizing and configuring the cleaning head 32 for a given cleaning operation. Similarly, the overall size, shape, and configuration of the cleaning head 32 and/or the vacuum chamber 98 may also be configured complementary to the size, shape and configuration of the object 8 to be cleaned by the cleaning head 32.

Referring again to FIG. 1, in another implementation, the system 10 may also include the fluid injection unit 86 for injecting cleaning solution 124 into the cleaning medium supply line 46 for mixing with the cleaning medium 26 that is provided to the cleaning head 32 (e.g., to the cleaning medium dispenser 22).

The cleaning solution 124 of the fluid injection unit 86 may be provided in a composition that may promote or expedite the cleaning of the object 18. For example, the cleaning solution 124 may include detergent and/or chemicals for injection into the cleaning medium supply line 46, which results in a mixture of molecules of detergent and/or chemicals in the cleaning medium 26. The detergent and/or chemicals may include, but are not limited to, solvents for breaking up or dissolving certain type of debris 30 into smaller debris particles. The detergent and/or chemicals may surround the debris 30 once the debris particles are broken loose from the surface 16 of the object 18. The detergent and/or chemicals may encapsulate the debris particles and prevent the debris particles from re-attaching to one another and/or re-bonding to the surface 16 of the object 18.

For example, the cleaning solution 124 may include a composition for enhancing the cleaning of certain types of debris 30, such as water- and/or oil-based fluids (e.g., hydraulic fluids and greases). The cleaning solution 124 may be injected into the cleaning medium 26 in a predetermined amount (e.g., upon activation of a release valve). The mixture of detergent and chemical molecules in the cleaning medium 26 (e.g., the steam cloud or hot water) may penetrate the relatively cooler debris 30 on the surface 16 of the object 18 and may further facilitate dislodgment of the debris 30. In this regard, the cleaning solution 124 may include any one of a variety of other compositions, without limitation, for expediting or enhancing the cleaning of certain types of debris 30.

Alternatively, the cleaning solution 124 (e.g., detergent and/or chemicals) may be applied directly to the surface 16 of the object 18.

Figure 5:
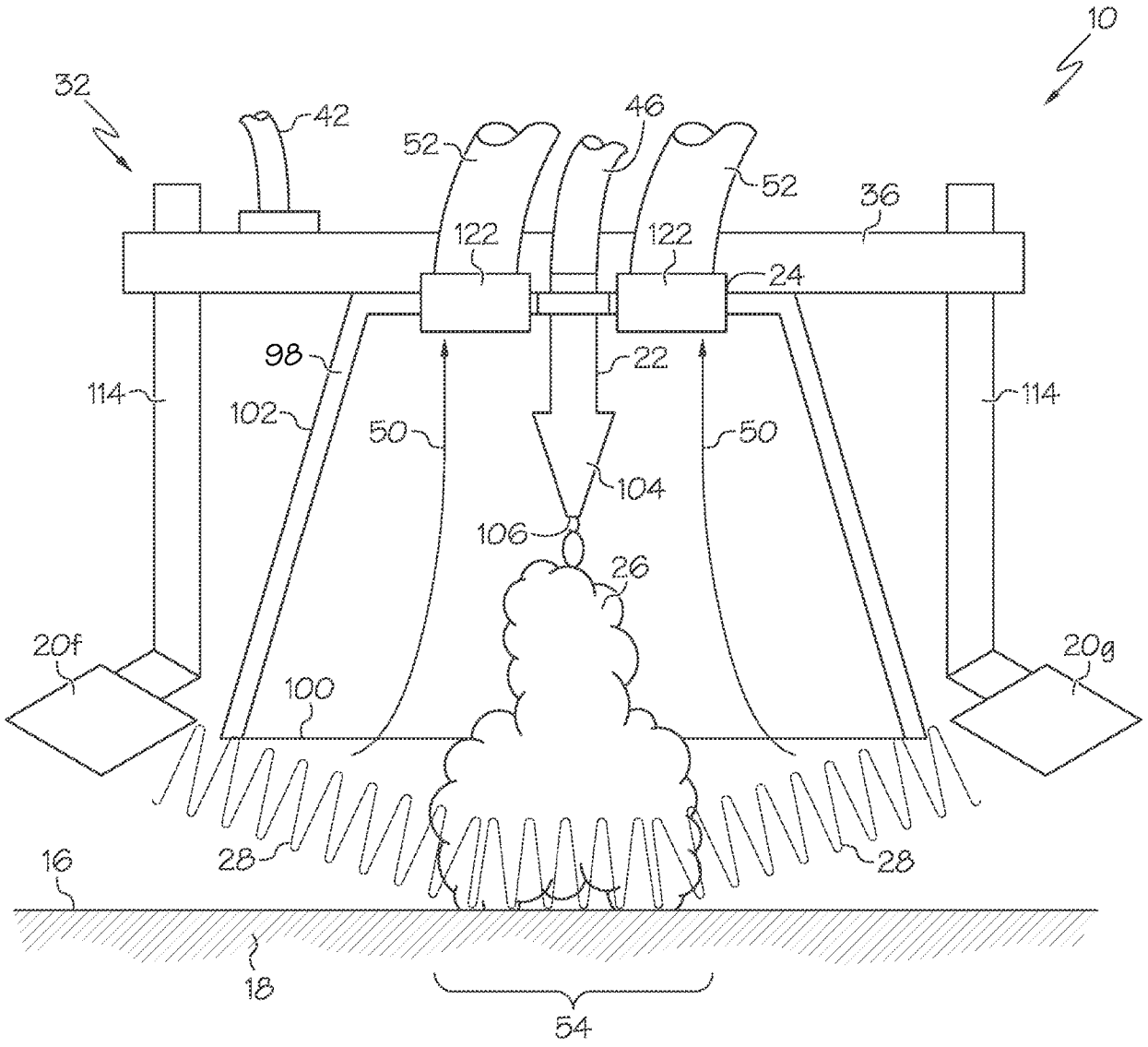
FIG. 5 is a schematic illustration of another implementation of the cleaning head of the system of FIG. 1.

Referring to FIG. 5, in another implementation of the cleaning head 32, ultrasonic devices 20 (referred to individually as ultrasonic devices 20*f* and 20*g*) may be located only outside of the vacuum chamber 98. For example, ultrasonic devices 20*f* and 20*g* may be attached to one or more holding fixtures 114. The holding fixture 114 may be attached (e.g., removably attached) to the end adaptor 36. Ultrasonic devices 20*f* and 20*g* may be positioned at a fixed location on an associated holding fixture 114 or may be movable (e.g., manually or electromechanically) relative to the associated holding fixture 114. Ultrasonic devices 20*f* and 20*g* may generate ultrasonic waves 28 (e.g., longitudinal waves and/or shear waves) in the object 18.

The cleaning medium dispenser 22 may deliver cleaning medium 26 (e.g., steam) to the surface 16 of the object 18 to dislodge the debris 30 (FIG. 1). The ultrasonic waves 28 (e.g., longitudinal and/or shear waves) may atomize the cleaning medium 26 holding the debris 30 (e.g., particles of debris 30), which may them be collected by the vacuum airflow 50.

Referring to FIG. 6, in another aspect, the disclosed system may include a holding fixture 56 configured to hold and/or support the object 18. For example, the holding fixture 56 may be a component assembly fixture used to hold the object 18 during a fabrication, assembly and/or maintenance operation (e.g., as part of an assembly line) and during a cleaning operation. As another example, the holding fixture 56 may be used to hold the object 18 only during a cleaning operation. As yet another example, the holding fixture 64 may be a part of the object 18.

At least one ultrasonic device 58 may be coupled to the holding fixture 56. The ultrasonic devices 58 may deliver ultrasonic waves 62 to the object 18 through the holding fixture 56. At least one ultrasonic generator 72 may supply energy to the ultrasonic devices 58. An ultrasonic supply line 74 may electrically couple the ultrasonic generator 72 to the ultrasonic devices 58 such that ultrasonic waves 62 may be applied through the entire object 18.

Each ultrasonic device 58 may be an ultrasonic transducer that converts energy into ultrasound (e.g., sound waves). For example, the ultrasonic device 58 may be a piezoelectric transducer that converts electrical energy into sound.

During a cleaning operation, the cleaning head 32 may be positioned in close proximity to the surface 16 of the object 18, for example by the robotic assembly 34. The cleaning medium 26 may be delivered to the surface 16 of the object 18 (e.g., about the cleaning zone 54) from the cleaning medium dispenser 22 to dislodge debris 30 on the surface 16. The ultrasonic waves 28 generated by the ultrasonic devices 20 in the cleaning head 32 and delivered to the surface 16 of the object 18 may work in concert with the ultrasonic waves 62 generated by the ultrasonic devices 58 of the holding fixture 56 and delivered into the object 18 to atomize the cleaning medium 26. The vacuum 24 may vacuum the atomized cleaning medium 26 and the dislodged debris 30 (e.g., debris particles held within the cleaning medium 26).

As used herein, close proximity may include a position close to the surface 16 of the object 18 without touching the object 18. As an example, close proximity may include positions of at most approximately 12 inches from the surface 16. As another example, close proximity may include positions of at most approximately 6 inches from the surface 16. As another example, close proximity may include positions of at most approximately 3 inches from the surface 16. As another example, close proximity may include positions of at most approximately 1 inch from the surface 16. As yet another example, close proximity may include positions as close to the surface 16 as possible without contacting the surface 16.

Those skilled in the art will appreciate that the proximity to the surface 16 of the object 18 may depend upon the size, power and/or configuration of the ultrasonic devices 20, the cleaning medium dispenser 22, the vacuum 24, the ultrasonic devices 58 and/or the ultrasonic devices 126 in order to effectively perform a cleaning operation.

Figure 7:
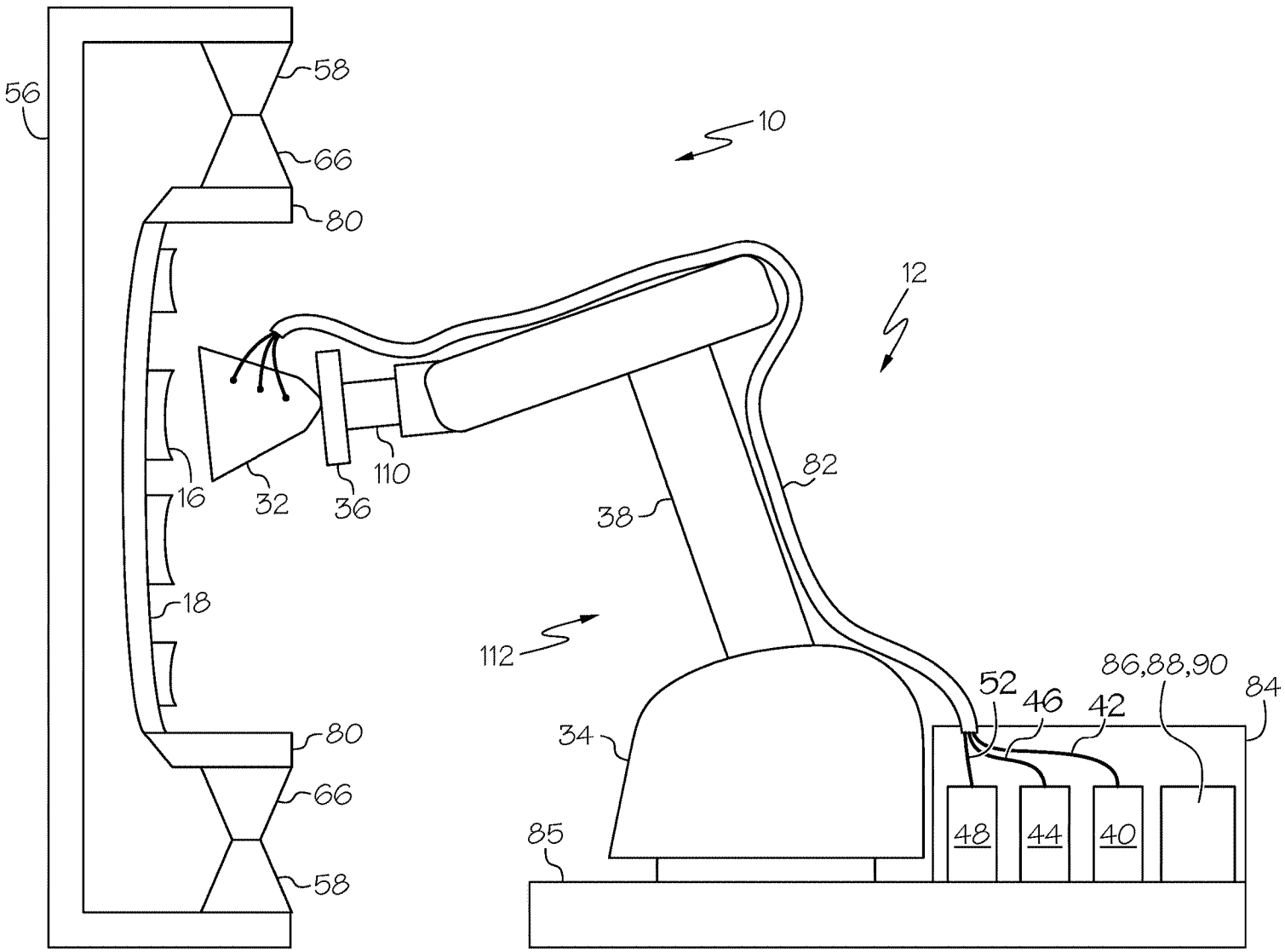
FIG. 7 is a schematic illustration of one implementation of the system of FIG. 6.

Referring to FIG. 7, in an example implementation, the holding fixture 56 may include at least one object holding fixture 66 configured to engage at least a portion (e.g., an edge) of the object 18 to secure the object 18 to the holding fixture 56 and fix the position of the object 18. For example, each object holding fixture 66 may include an edge holding fixture 80 to engage at least one edge of the object 18 (e.g., an aircraft wing panel).

An ultrasonic device 58 may be coupled to each of the object holding fixtures 66 to transfer ultrasonic waves 62 (e.g., vibrations) (FIG. 6) through the object holding fixtures 66 and into the object 18. Each ultrasonic device 58 may be physically coupled to the object holding fixtures 66 (e.g., a contact ultrasonic transducer) or air coupled to the object holding fixtures 66 (e.g., a non-contact ultrasonic transducer). The object holding fixtures 66, including any edge holding fixtures 80, may be acoustically coupled to the holding fixture 56 and the object 18 such that the ultrasonic waves 62 applied to the object holding fixtures 66 sufficiently transfer between and through the holding fixture 56, the object holding fixtures 66 and into the object 18.

As used herein, acoustically coupled means that all parts and/or components of the holding fixture 56 are connected together such that the entire construction is acoustically available (e.g., an acoustically resonating system) for effective transmission and propagation of ultrasonic waves 62. For example, the holding fixture 56 may be constructed such that no gaps occur between components and the propagation of ultrasonic waves 62 is not lost through component and/or surface interfaces.

Figure 8:
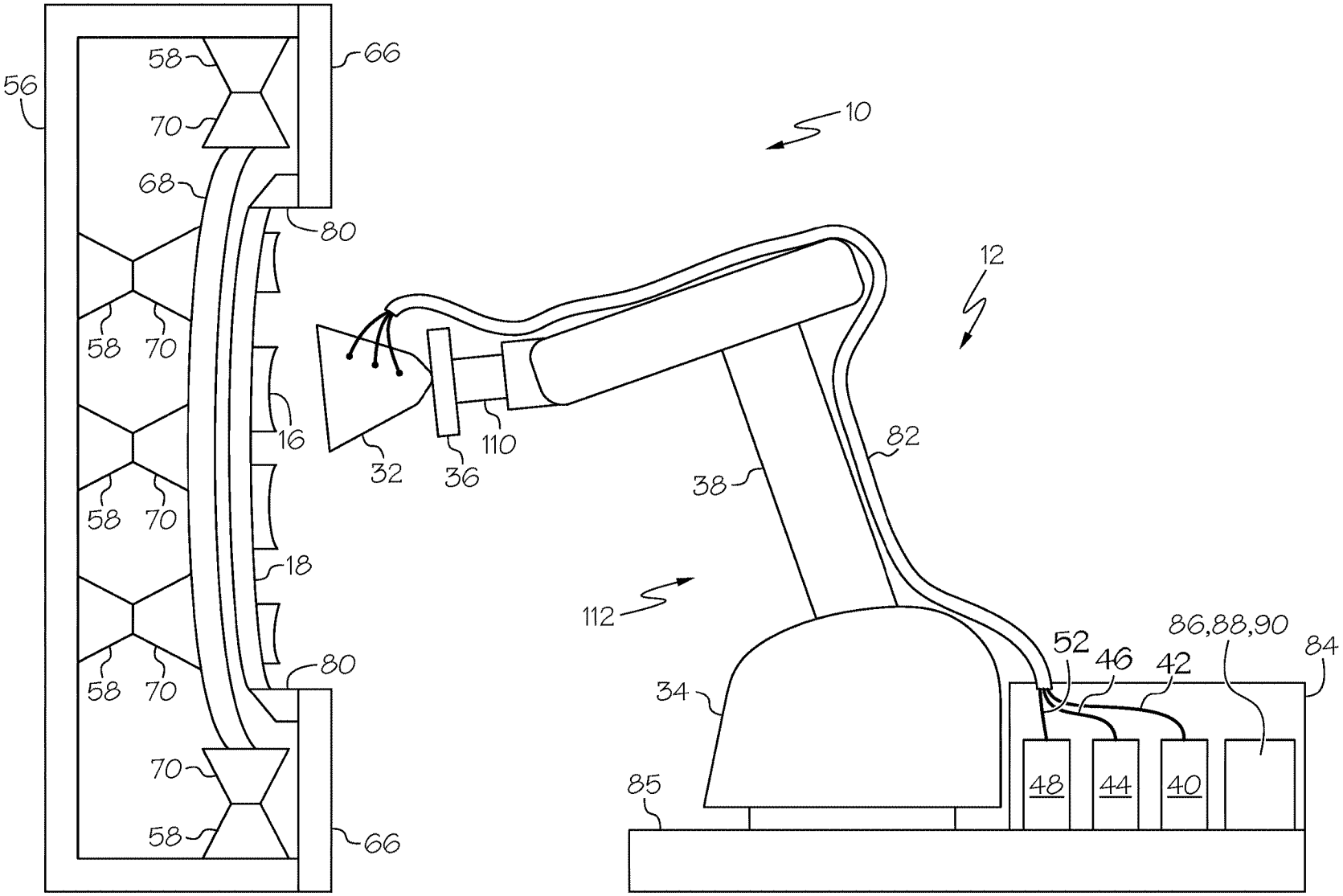
FIG. 8 is a schematic illustration of another implementation of the system of FIG. 6.

Referring to FIG. 8, in another implementation, the object 18 may be mounted to a support base 68. The object 18 may be in contact with the support base 68 or may be spaced apart a predetermined distance from the support base 68. The holding fixture 56 may include at least one support base holding fixture 70 configured to engage at least a portion of the support base 68 to secure the support base 68 to the holding fixture 56 and fix the position of the object 18.

An ultrasonic device 58 may be coupled to each of the support base holding fixtures 70 to transfer ultrasonic waves 62 (FIG. 6) through the support base holding fixtures 70, through the support base 68 and into the object 18. The ultrasonic devices 58 may be physically coupled to the support base holding fixtures 70 or air coupled to the support base holding fixtures 70. The support base holding fixtures 70 may be acoustically coupled to the holding fixture 56 and the support base 68 such that the ultrasonic waves 62 applied to the support base holding fixtures 70 sufficiently transfer between and through the holding fixture 56, the support base holding fixtures 70, the support base 68 and into the object 18. Any object holding fixtures 66, including any edge holding fixtures 80, may similarly be acoustically coupled to the holding fixture 56.

Figure 9:
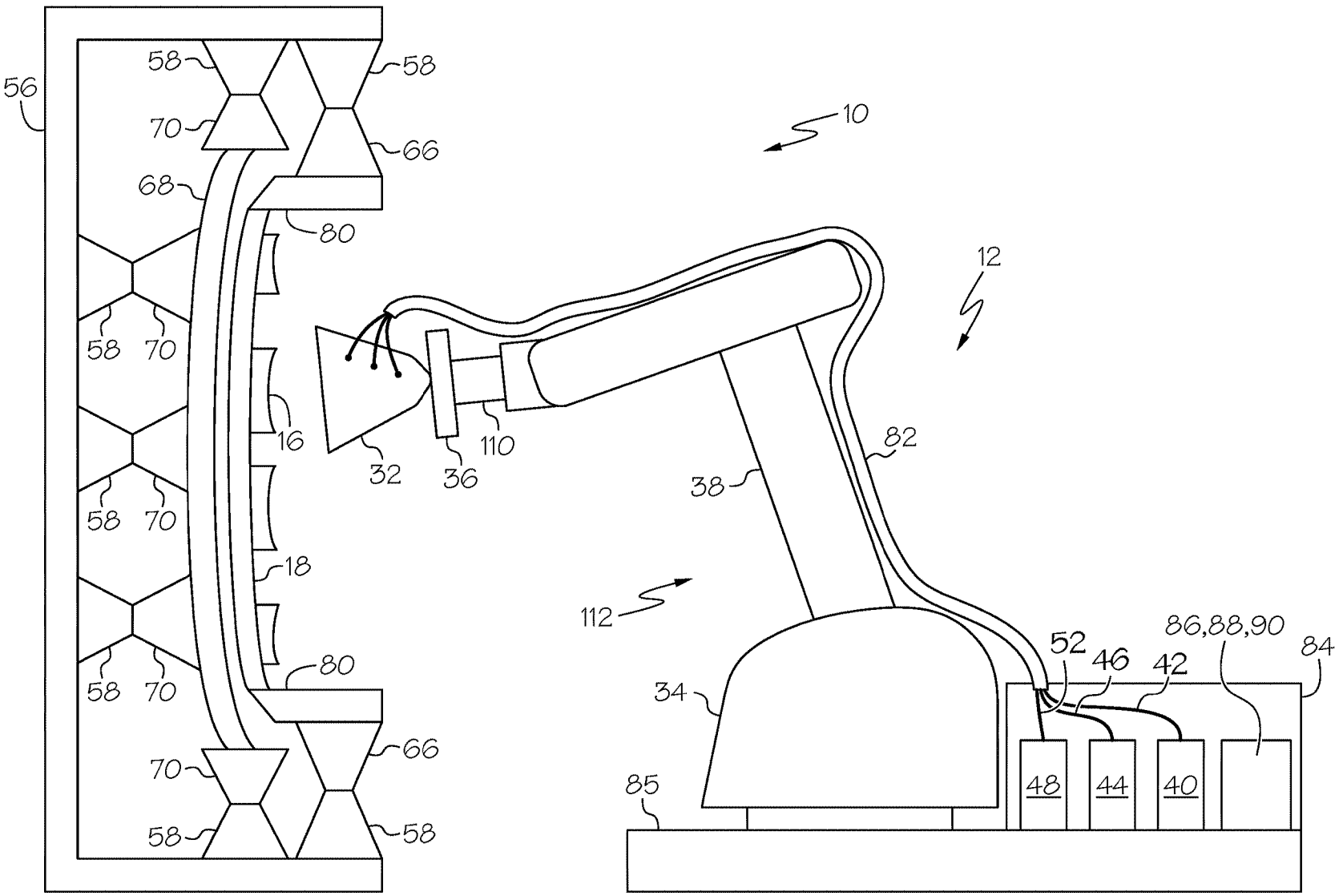
FIG. 9 is a schematic illustration of another implementation of the system of FIG. 6.

Referring to FIG. 9, in yet another example construction, the object 18 may be mounted to the support base 68 and the holding fixture 56 may include at least one object holding fixture 66 and at least one support base holding fixture 70 to secure the support base 68 and the object 18 to the holding fixture 56 and fix the position of the object 18 with respect to the cleaning head 32 and/or the movable assembly 112 (e.g., the robotic assembly 34).

An ultrasonic device 58 may be coupled to each of the object holding fixtures 66 and each of the support base holding fixtures 70 to transfer ultrasonic waves 62 (FIG. 6) through the object holding fixtures 66 and the support base holding fixtures 70, through the support base 68 and into the object 18. The ultrasonic devices 58 may be physically coupled to the object holding fixtures 66 and the support base holding fixtures 70 or air coupled to the object holding fixtures 66 and the support base holding fixtures 70. The object holding fixtures 66 and the support base holding fixtures 70 may be acoustically coupled to the holding fixture 56 and the support base 68 such that the ultrasonic waves 62 applied to the object holding fixtures 66 and the support base holding fixtures 70 sufficiently transfer between and through the holding fixture 56, the object holding fixtures 66, the support base holding fixtures 70, the support base 68 and into the object 18.

The object holding fixtures 66 and/or the support base holding fixtures 70 may be integral to the holding fixture 56 or may be installed on or connected to the holding fixture 56. The ultrasonic generator 72 (FIG. 6) may be integral to the holding fixture 56 or may be remote and electrically coupled to the ultrasonic devices 58.

Thus, in concert with the ultrasonic devices 58, the object holding fixtures 66 and/or the support base holding fixtures 70 may form an acoustically resonating system that delivers ultrasonic waves 62 (e.g., vibrations) into and through the entire object 18. A plurality of ultrasonic devices 58 may be arranged in any configuration (e.g., in an array of ultrasonic devices 58). Each ultrasonic device 58 may have a fixed position or may be movable with respect to the holding fixture 56, the object holding fixtures 66 and/or the support base holding fixtures 70. For example, the position, orientation and/or location of the ultrasonic devices 58 may be manually movable or electromechanically movable. By placing, activating and tuning the ultrasonic devices 58, various types of guided ultrasonic waves 62 may be created on the surface 16 of the object 18 at desired locations (e.g., cleaning zones 54). For example, the ultrasonic waves 62 may create acoustic streaming within the cleaning medium 26 (e.g., movement of the cleaning fluid in response to the ultrasonic waves 62)

Figure 10:
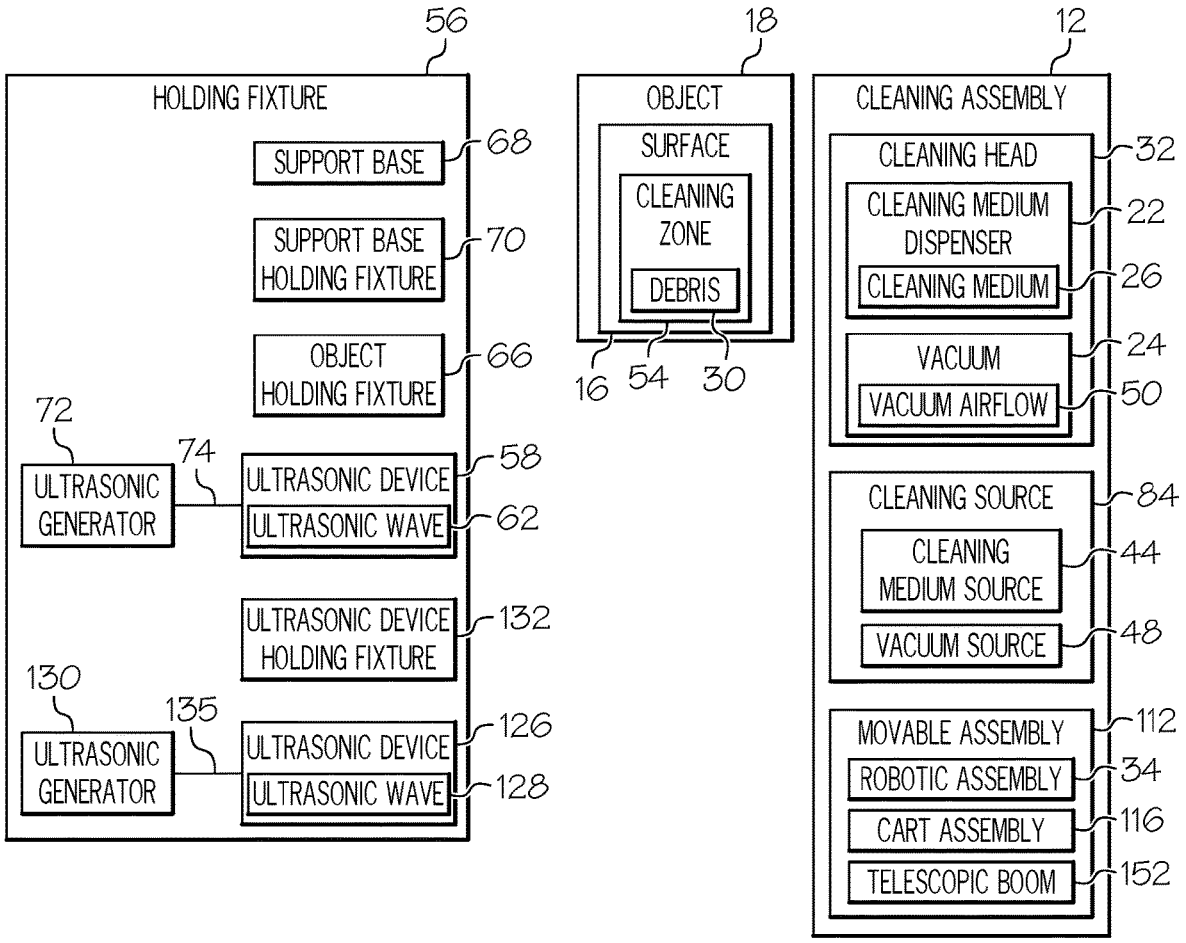
FIG. 10 is a block diagram of another aspect of the disclosed system.

Referring to FIG. 10, in another aspect, the disclosed system may include holding fixture 56 configured to hold and/or support the object 18 and at least one ultrasonic device 58 coupled to the holding fixture 56. The ultrasonic devices 58 may deliver ultrasonic waves 62 to the object 18 through the holding fixture 56. At least one ultrasonic generator 72 may supply energy to the ultrasonic devices 58. An ultrasonic supply line 74 may couple the ultrasonic generator 72 to the ultrasonic devices 58 such that ultrasonic waves 62 may be applied through the entire object 18.

At least one ultrasonic device 126 may be attached to the holding fixture 56. The ultrasonic devices 126 may deliver ultrasonic waves 128 to the object 18. At least one ultrasonic generator 130 may supply energy to the ultrasonic devices 126. An ultrasonic supply line 135 may couple the ultrasonic generator 130 to the ultrasonic devices 126 such that ultrasonic waves 128 may be applied to the surface 16 of the object 18. The ultrasonic generator 130 may be integral to the holding fixture 56 or may be remote and coupled to the ultrasonic devices 126.

Each ultrasonic device 58 and each ultrasonic device 126 may be an ultrasonic transducer that converts energy into ultrasound. For example, the ultrasonic device 58 and ultrasonic device 126 may be a piezoelectric transducer that converts electrical energy into sound.

The cleaning head 32 may include only the cleaning medium dispenser 22 and the vacuum 24. During a cleaning operation, the cleaning head 32 may be positioned in close proximity to (e.g., close to but not in contact with) the surface 16 of the object 18, for example by the movable assembly 112 (e.g., the robotic assembly 34). The cleaning medium 26 may be delivered to the surface 16 of the object 18 (e.g., about the cleaning zone 54) from the cleaning medium dispenser 22 to dislodge debris 30 on the surface 16. The ultrasonic waves 62 generated by the ultrasonic devices 58 of the holding fixture 56 and delivered into the object 18 may work in concert with the ultrasonic waves 128 generated by the ultrasonic devices 126 and delivered to the surface 16 of the object 18 to atomize the cleaning medium 26. The vacuum 24 may vacuum the atomized cleaning medium 26 and the dislodged debris 30 (e.g., debris particles held within the cleaning medium 26).

Figure 11:
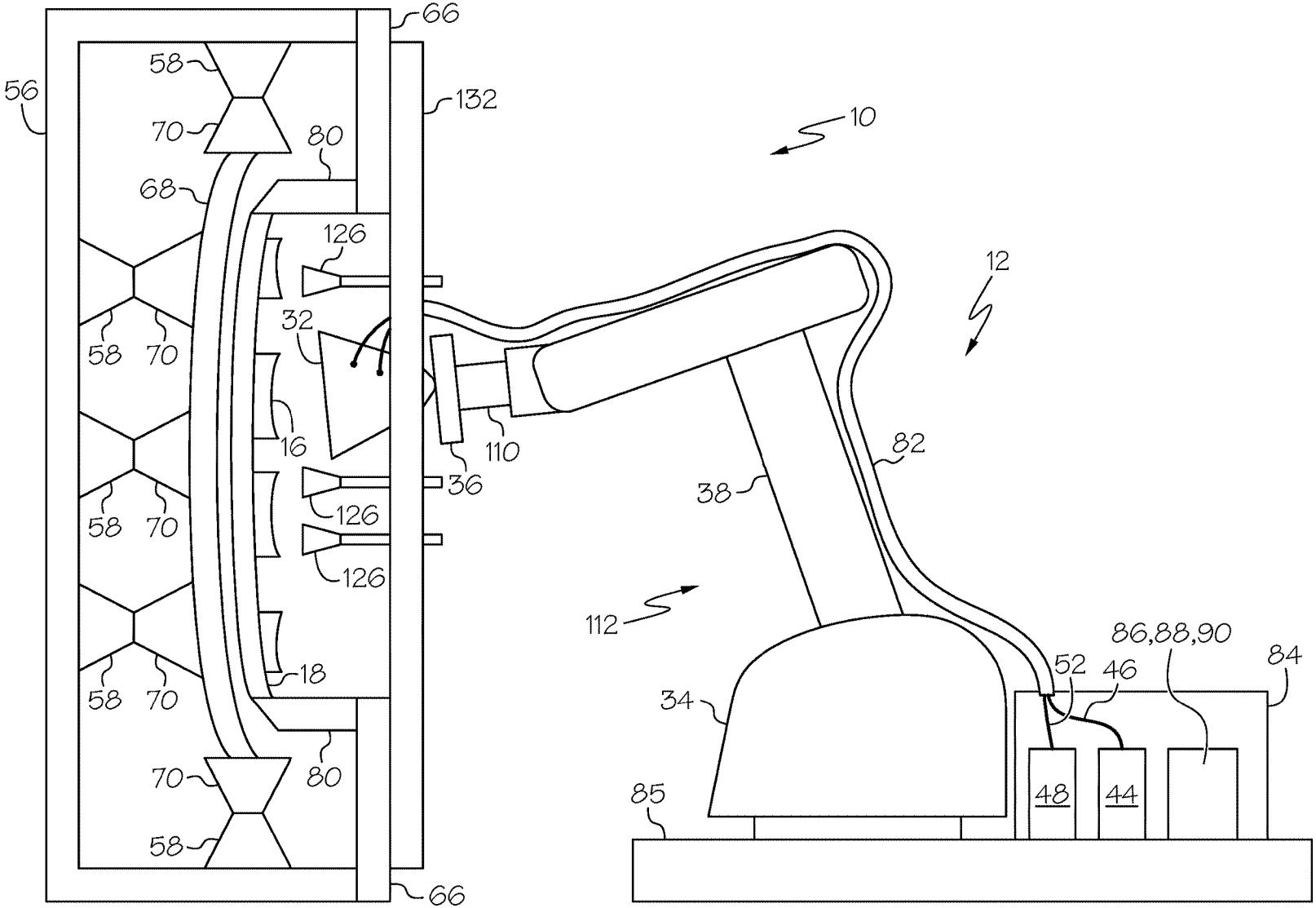
FIG. 11 is a schematic illustration of one implementation of the system of FIG. 10.

Referring to FIG. 11, in an example implementation, the object 18 may be mounted to the support base 68. The holding fixture 56 may include at least one support base holding fixture 70 to engage at least a portion of the support base 68 to secure the support base 68 to the holding fixture 56 and fix the position of the object 18. The holding fixture 56 may include at least one object holding fixture 66 to engage at least a portion (e.g., an edge) of the object 18 to secure the object 18 fix the position of the object 18.

An ultrasonic device 58 may be coupled to each of the support base holding fixtures 70 to transfer ultrasonic waves 62 (FIG. 10) through the support base holding fixtures 70, through the support base 68 and into the object 18. The ultrasonic devices 58 may be physically coupled to the support base holding fixtures 70 or air coupled to the support base holding fixtures 70. The support base holding fixtures 70 may be acoustically coupled to the holding fixture 56 and the support base 68 such that the ultrasonic waves 62 applied to the support base holding fixtures 70 sufficiently transfer between and through the holding fixture 56, the support base holding fixtures 70, the support base 68 and into the object 18. Similarly, the object holding fixtures 66, including any edge holding fixtures 80, may be acoustically coupled to the holding fixture 56.

Each ultrasonic device 126 may be an air coupled (e.g., non-contact) ultrasonic transducer. One or more ultrasonic devices 126 may be attached to the holding fixture 56, for example, to the object holding fixtures 66, by one or more ultrasonic device holding fixtures 132. A plurality of ultrasonic devices 126 may be positioned and/or arranged in any configuration (e.g., in an array of ultrasonic devices 126) set apart from the cleaning head 32. The ultrasonic device holding fixture 132 may provide for position adjustability of the ultrasonic devices 126. For example, the ultrasonic devices 126 may be positioned on opposing sides of the location of the cleaning head 32 and may move along with the cleaning head 32 during a cleaning operation.

Figure 12:
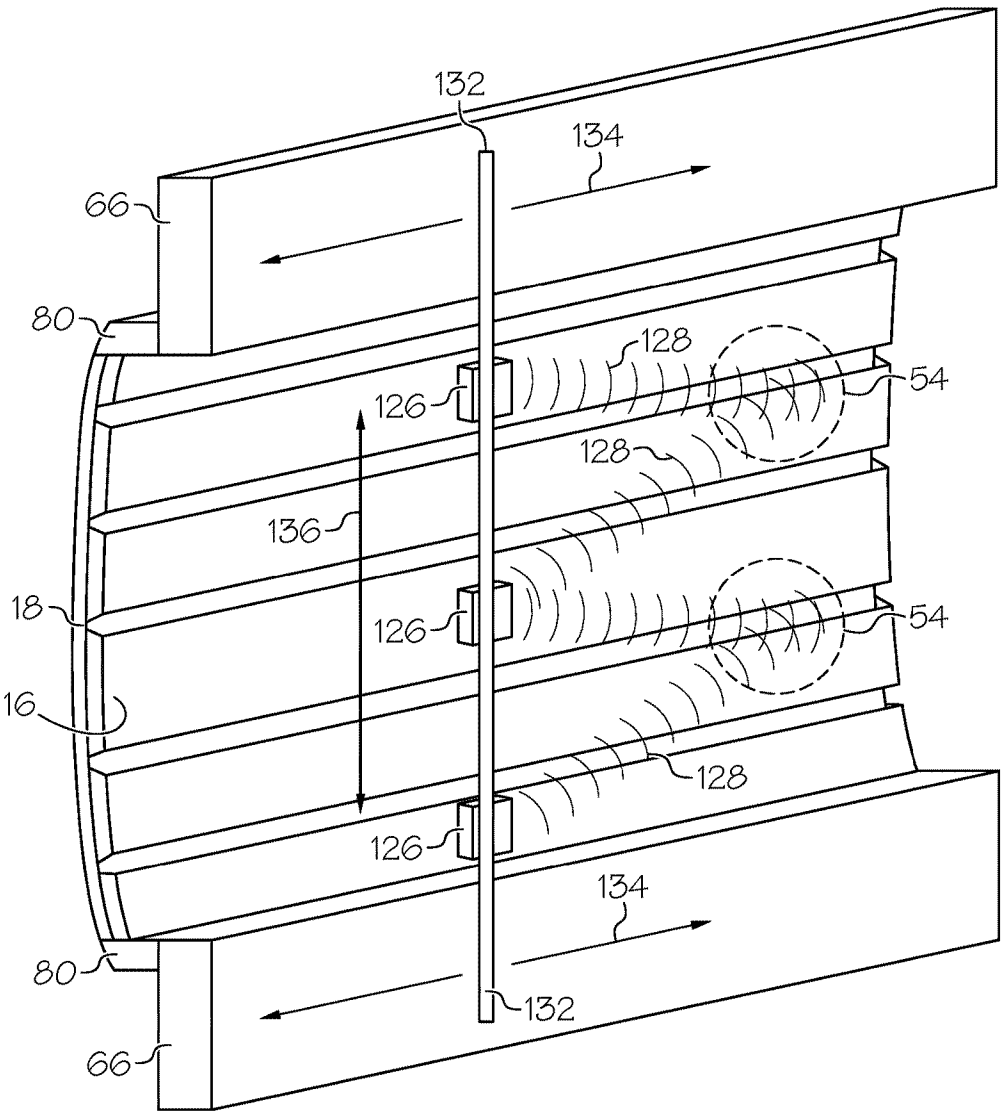
FIG. 12 is schematic illustration of another implementation of the system of FIG. 10.

Referring to FIG. 12, the ultrasonic device holding fixture 132 may be movably connected to the holding fixture 56. The ultrasonic device holding fixture 132 may provide for movement of the ultrasonic devices 126 along at least two axes. For example, the ultrasonic device holding fixture 132 may be movably connected to the object holding fixtures 66 and movable along an X-axis (e.g., in the direction of arrow 134). The ultrasonic devices 126 may be movably connected to the ultrasonic device holding fixture 132 and movable along a Y-axis (e.g., in the direction of arrow 136).

The ultrasonic device holding fixture 132 and the ultrasonic devices 126 may be manually movable or may be automatically or semi-automatically movable (e.g., by an electromechanical drive mechanism (not shown)).

Figure 13:
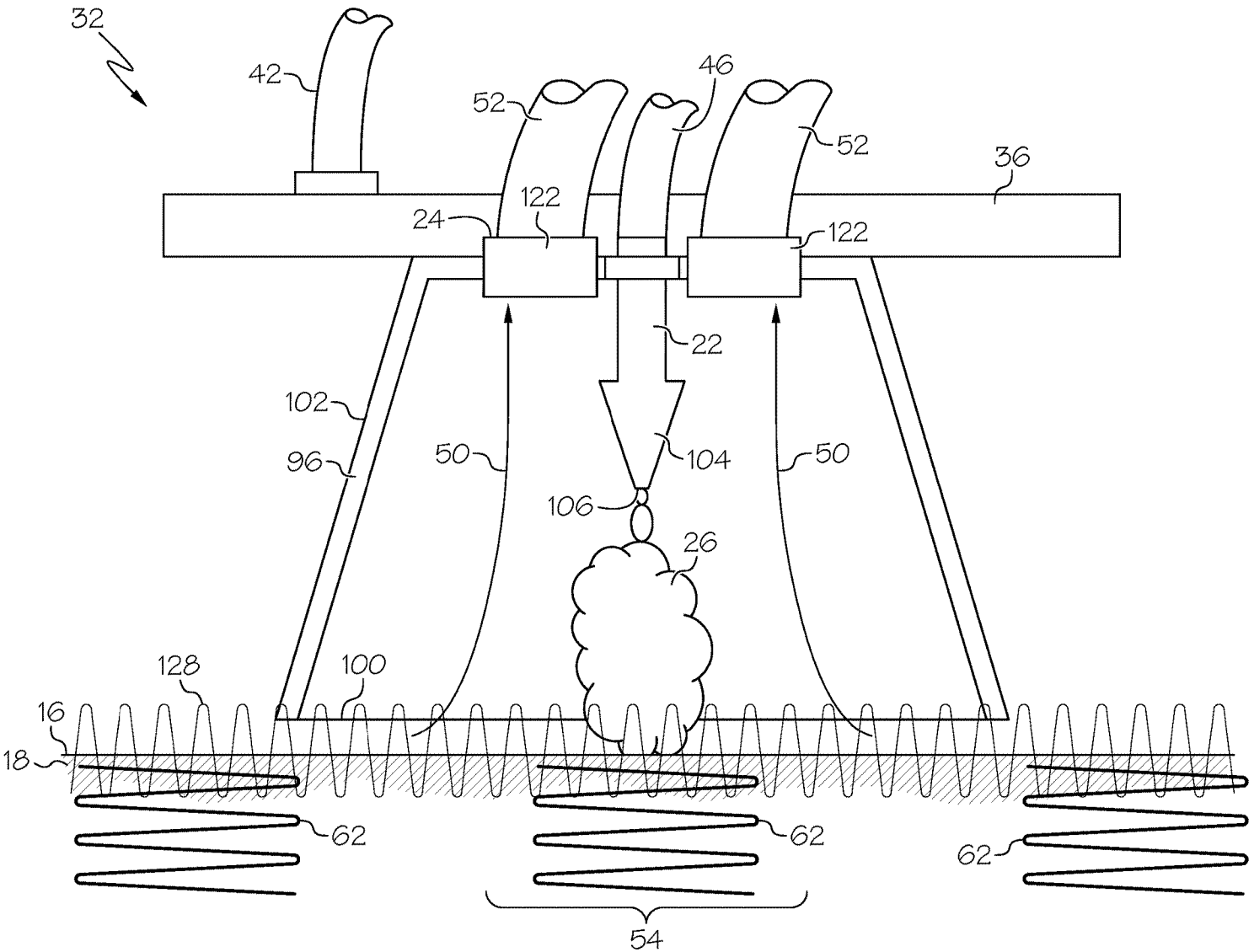
FIG. 13 is a schematic illustration of one implementation of the cleaning head of the system of FIG. 10.

Referring to FIG. 13, in an example implantation, the cleaning head 32 may include the vacuum chamber 98 having an open end 100. The size of the cleaning zone 54 may be determined by area covered by the cleaning medium 26, the vacuum airflow 50 and ultrasonic waves 62 and/or ultrasonic waves 128. The cleaning medium dispenser 22 may be located within the vacuum chamber 98 at an orientation sufficient to deliver the cleaning medium 26 to the surface 16 of the object 18. The vacuum 24 (FIG. 10) may be fluidly coupled to the vacuum supply line 52 to provide vacuum suctioning (e.g., vacuum airflow 50) within the vacuum chamber 98 and/or to the surface 16 of the object 18.

The ultrasonic devices 58 and ultrasonic devices 126 (FIG. 10) may be configured to generate a variety of different types of ultrasonic waves 62 applied into the object 18 and ultrasonic waves 128 applied to the surface 16 of the object 18, respectively, including, but not limited to, longitudinal waves, shear waves, surface waves and/or plate waves. For example, ultrasonic device 58 may generate longitudinal and/or shear waves 62 in the object 18 and ultrasonic devices 126 may generate surface and/or plate waves 128 on the surface 16 of the object 18.

Those skilled in the art will appreciate that any individual ultrasonic device 20, ultrasonic device 58, ultrasonic device 126 and/or combinations of ultrasonic devices 20, 58 and 126 (FIG. 6) may be configured (e.g., tuned and positioned) to generate any combination of guided ultrasonic waves (e.g., longitudinal waves and/or shear waves in the object 18 and/or surface waves and/or plate waves on the surface 16 of the object 18).

For example, the different types of ultrasonic waves 28, ultrasonic waves 62 and ultrasonic waves 128 (FIG. 6) (e.g., longitudinal waves, shear waves, surface waves and/or plate waves) may be generated by adjusting the angles of incidence of the ultrasonic devices 20, ultrasonic devices 58 and ultrasonic devices 128 (FIG. 6) relative to the surface 16 of the object 18. As an example, positioning (e.g., rotating) the ultrasonic device approximately 10° from normal (e.g., from the plane of the surface 16) may generate plate waves perpendicular to and on the surface 16 of the object 18. As another example, positioning (e.g., rotating) the ultrasonic device approximately 0° from normal (e.g., parallel to the plane of the surface 16) may generate longitudinal waves in the object 18. As another example, shear waves may be generated under any angle of incidence and may propagate perpendicularly relative to the wave into the object 18. As yet another example, surface waves may be generated under any angle of incidence and may propagate concentrically (e.g., elliptically) on the surface 16 of the object 18.

Figure 14:
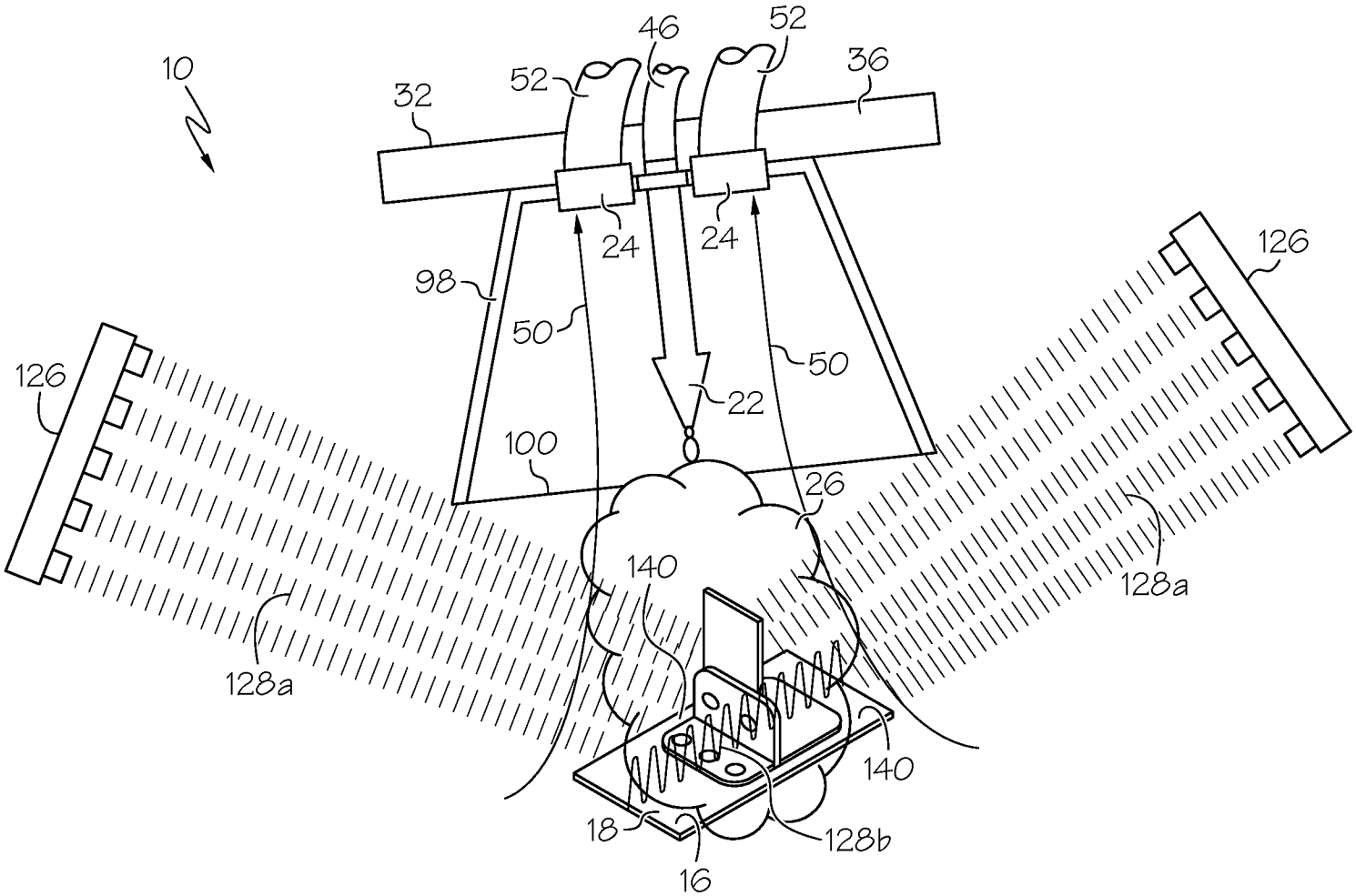
FIG. 14 is a schematic view of another implementation of the system of FIG. 10.
Figure 15:
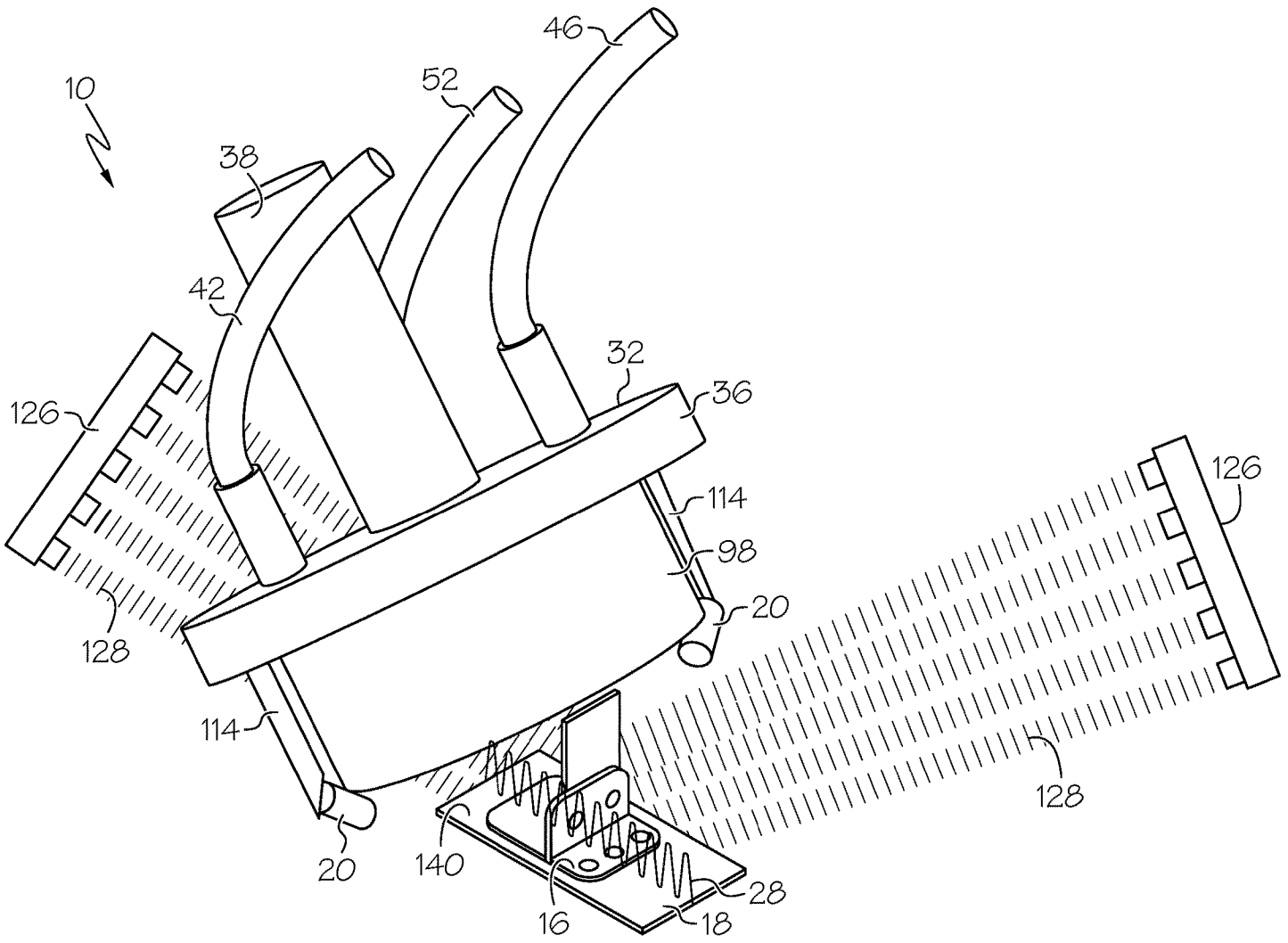
FIG. 15 is a schematic illustration of another implementation of the system of FIG. 6.

Referring to FIGS. 14 and 15, in an example implementation, one or more three-dimensional cleaning zones 54 (e.g., an ultrasonic interaction volume 140) may be formed around a complex object 18 (e.g., a mounting clip) by the interference of a plurality of focused ultrasonic waves.

As an example and best illustrated in FIG. 14, a plurality of air coupled ultrasonic devices 126 (e.g., such as the ultrasonic devices 126 shown and described in FIGS. 10-12) may be located in relative close proximity to (e.g., between approximately 1 and 12 inches from) the object 18. The cleaning head 32 (e.g., such as the cleaning head 32 shown and described in FIGS. 10-12) may be located in relative close proximity (e.g., between approximately 1 and 12 inches from) to the object 18. The cleaning head 32 may deliver cleaning medium 26 (e.g., steam) to one or more surfaces 16 of the object 18 to dislodge debris 30 from the surfaces 16 of the object 18. The ultrasonic devices 126 may generate ultrasonic waves **128*a* (e.g., longitudinal waves and/or shear waves in the object 18) and ultrasonic waves 128*b* (e.g., plate waves and/or shear waves on the surface 16 of the object 18) to atomize the cleaning medium 26 and debris 30 (e.g., debris particles retained by the cleaning medium 26). The vacuum 24 may provide vacuum suctioning (e.g., vacuum airflow 50) within the vacuum chamber 98 and/or to the surface 16 of the object 18 to remove the atomized cleaning medium 26 and debris 30**.

The plurality of ultrasonic devices 126 (e.g., an array of ultrasonic device 126) may emit the ultrasonic waves **128*a* and 128*b*, which are focused toward the object 18 and interfere with each other at the object 18. The interfering ultrasonic waves 128*a* and 128*b* may form the ultrasonic interaction volume 140 around the object 18, which generates the longitudinal waves and/or shear waves in the object 18 and the plate waves and/or shear waves on the surface 16 of the object 18**.

As another example (not shown), the object 18 (e.g., having a relatively complex three-dimensional surface 16) may be mounted to a holding fixture (e.g., the holding fixture 56 shown and described in FIGS. 6-9). A plurality of ultrasonic devices 126 may generate ultrasonic waves 128 directed to the object 18. A plurality of ultrasonic devices (e.g., ultrasonic devices 58 shown and described in FIGS. 6-9) may generate ultrasonic waves 62 directed through the holding fixture 56 and into the object 18. The interference of ultrasonic waves 128 and ultrasonic waves 62 may generate the longitudinal waves and/or shear waves in the object 18 and the plate waves and/or shear waves on the surface 16 of the object 18 to atomize the cleaning medium 26 and debris 30 (e.g., debris particles retained by the cleaning medium 26). The vacuum 24 may provide vacuum suctioning (e.g., vacuum airflow 50) within the vacuum chamber 98 and/or to the surface 16 of the object 18 to remove the atomized cleaning medium 26 and debris 30.

The plurality of ultrasonic devices 126 (e.g., an array of ultrasonic device 126) may emit the ultrasonic waves 128 and the plurality of ultrasonic devices 58 (e.g., an array of ultrasonic devices 58) may emit the ultrasonic waves 62, which are focused toward the object 18 and interfere with each other at the object 18. The interfering ultrasonic waves 128 and 62 may form the ultrasonic interaction volume 140 around the object 18, which generates the longitudinal waves and/or shear waves in the object 18 and the plate waves and/or shear waves on the surface 16 of the object 18.

As yet another example and best illustrated in FIG. 15, a plurality of air coupled ultrasonic devices 126 (e.g., such as the ultrasonic devices 126 shown and described in FIGS. 10-12) may be located in relative close proximity to the object 18. The cleaning head 32 (e.g., such as the cleaning head 32 shown and described in FIGS. 1-5) may be located in relative close proximity to the object 18. The cleaning head 32 may deliver cleaning medium 26 (e.g., steam) to one or more surfaces 16 of the object 18 to dislodge debris 30 from the surfaces 16 of the object 18. The ultrasonic devices 126 may generate ultrasonic waves 128 directed to the object 18 (e.g., longitudinal waves and/or shear waves in the object 18). A plurality of ultrasonic devices 20 located with the cleaning head 32 (e.g., the ultrasonic devices 20 shown and described in FIGS. 1-5) may generate ultrasonic waves 28 directed to the object 18 (e.g., surface waves and/or plate waves on the surface of the object 18). The interference of ultrasonic waves 128 and ultrasonic waves 28 may generate the longitudinal waves and/or shear waves in the object 18 and the plate waves and/or shear waves on the surface 16 of the object 18 to atomize the cleaning medium 26 and debris 30 (e.g., debris particles retained by the cleaning medium 26). The vacuum 24 may provide vacuum suctioning (e.g., vacuum airflow 50) within the vacuum chamber 98 and/or to the surface 16 of the object 18 to remove the atomized cleaning medium 26 and debris 30.

The plurality of ultrasonic devices 126 (e.g., an array of ultrasonic device 126) may emit the ultrasonic waves 128 and the plurality of ultrasonic devices 20 (e.g., an array of ultrasonic devices 20) may emit the ultrasonic waves 28, which are focused toward the object 18 and interfere with each other at the object 18. The interfering ultrasonic waves 128 and 28 may form the ultrasonic interaction volume 140 around the object 18, which generates the longitudinal waves and/or shear waves in the object 18 and the plate waves and/or shear waves on the surface 16 of the object 18.

Figure 16:
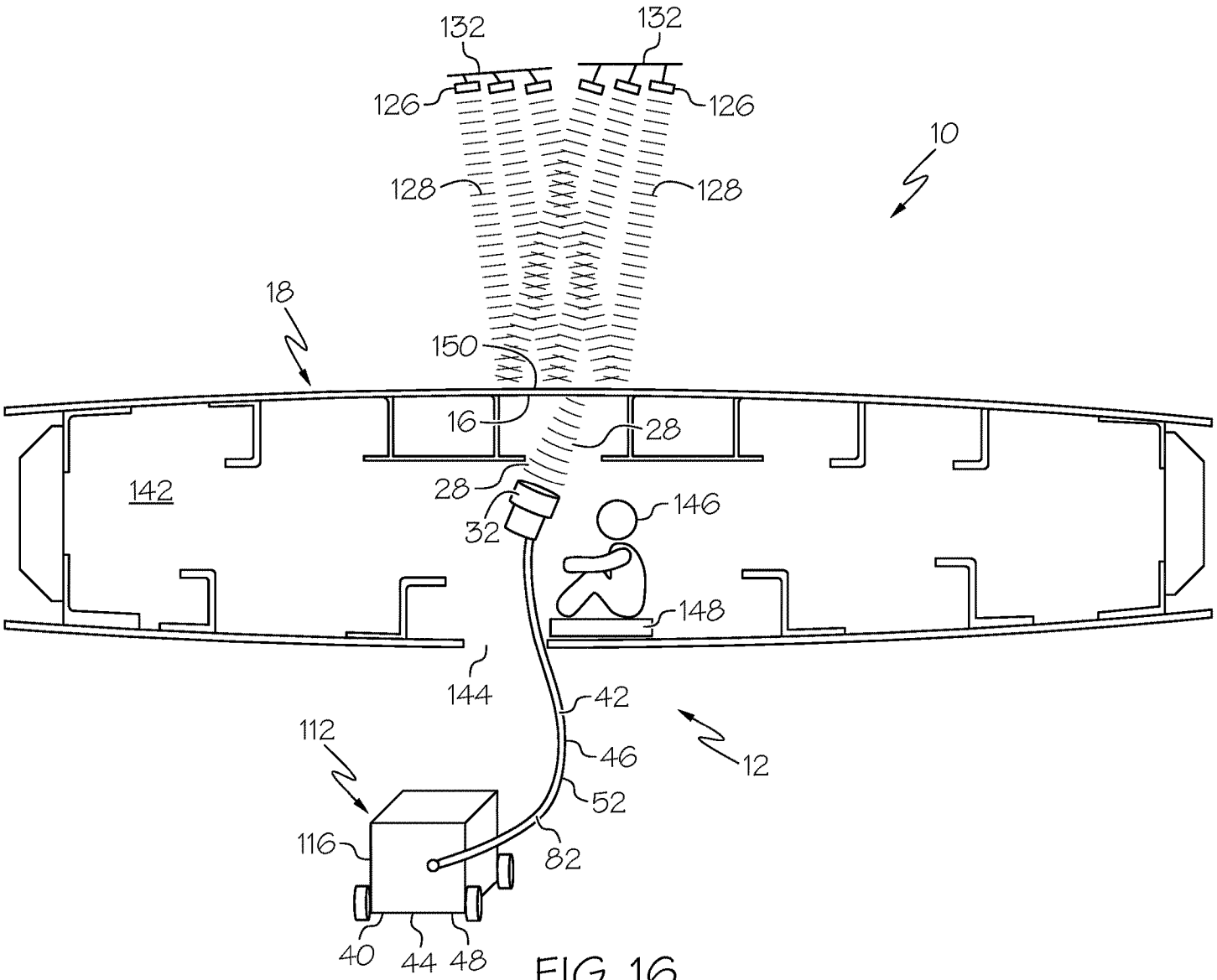
FIG. 16 is a schematic illustration of another implementation of the system of FIG. 6.
Figure 17:
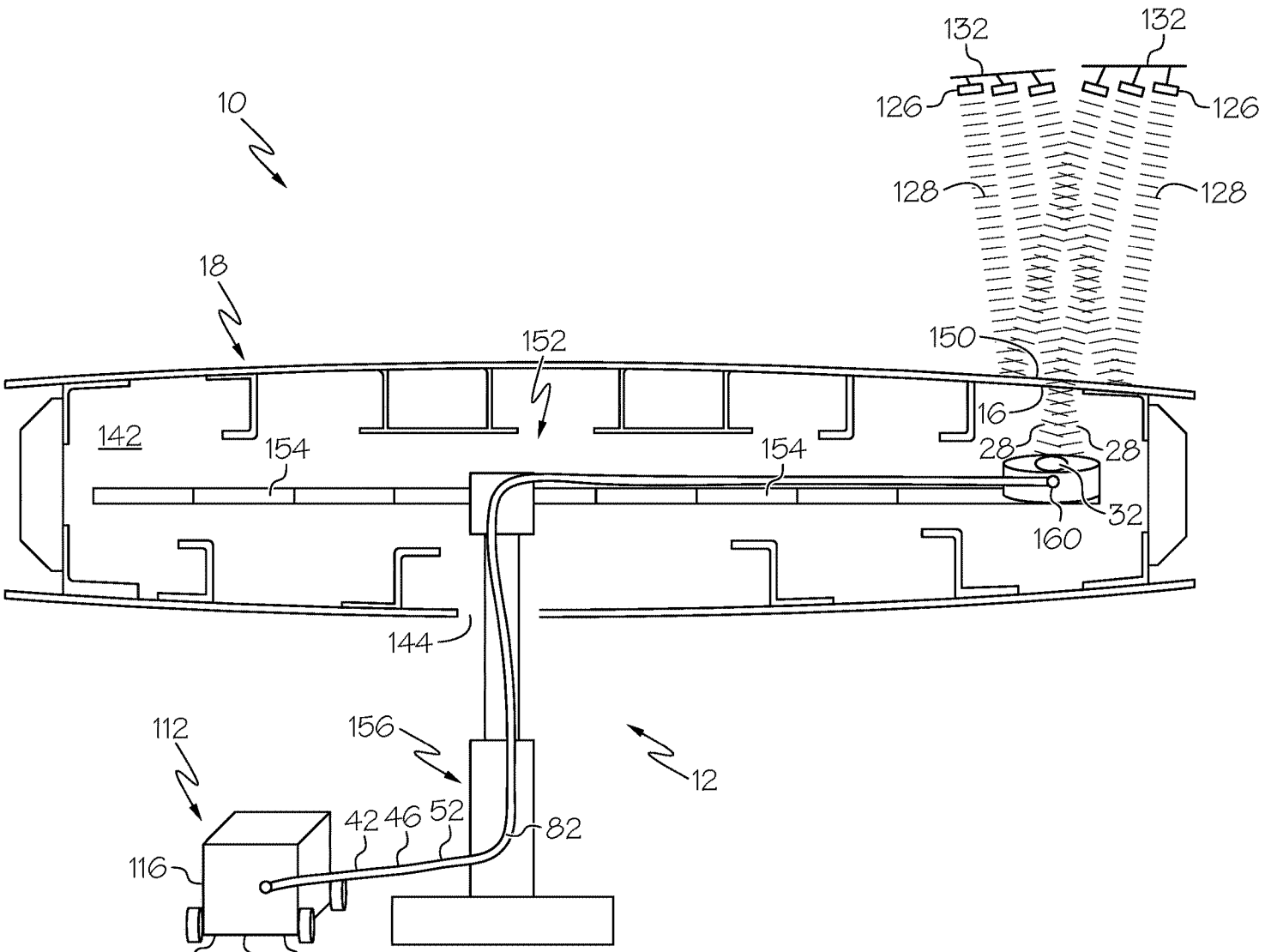
FIG. 17 is a schematic illustration of another implementation of the system of FIG. 6.

Referring to FIGS. 16 and 17, the disclosed system 10 may be configured to clean one or more confined surfaces 16 (e.g., interior surfaces) of an object 18. For example, the system 10 may be configured to clean interior surfaces 16 of the object 18, such as those located within a confined space 142 within the interior of the object 18 (e.g., interior surfaces of a wing box of an airplane fuel tank).

Referring to FIG. 16, in another implementation, the disclosed system 10 may include a handheld cleaning head 32. The cleaning head 32 (e.g., the cleaning head 32 shown and described in FIGS. 1-5) may include at least one cleaning medium dispenser 22 to deliver cleaning medium 26 to the surface 16 of the object 18, at least one air coupled ultrasonic device 20 to emit ultrasonic waves 28 to the surface 16 of the object 18 and at least one vacuum 24 to provide a vacuum airflow 50 to the surface 16 of the object 18.

The movable assembly 112 may be one or more cart assemblies 116. The cart assembly 116 may house the ultrasonic generator 40, the cleaning medium source 44 and the vacuum source 48. The cleaning head 32 may be functionally coupled to the cart assembly 116 by the supply line 82. For example, the ultrasonic supply line 42 may be coupled to the ultrasonic devices 20, the cleaning medium supply line 46 may be fluidly coupled to the cleaning medium dispenser 22 and the vacuum supply line 52 may be fluidly coupled to the vacuum 24.

During a cleaning operation, an operator 146 may be located within the confined space 142 and the cleaning head 32 may be introduced within the confined space 142, for example through an access port 144 in the object 18. The cleaning head 32 may be manually positioned in relatively close proximity to the surface 16 of the object 18 to be cleaned. The effective position of the cleaning head 32 relative to the surface 16 may be determined visually. For example, the effective position of the cleaning head 32 relative to the surface 16 may be determined by when the cleaning medium 26 and debris 30 begin to and/or fully atomize from the surface 16. Optionally, the operator 146 may be positioned on an ultrasonic acoustic absorber 148 to maintain an acoustically resonate system and protect the operator 146 from ultrasonic vibrations.

A plurality of ultrasonic devices 20 (e.g., an array of ultrasonic devices 20) may emit ultrasonic waves 28, for example from the cleaning head 32, directed toward the surface 16 and into the object 18. The ultrasonic waves 28 may be focused toward the surface 16 of the object 18 and generates the longitudinal waves and/or shear waves in the object 18 and/or the plate waves and/or shear waves on the surface 16 of the object 18 (e.g., ultrasonic vibrations in the object 18) to atomize the cleaning medium 26 and debris 30 (e.g., debris particles retained by the cleaning medium 26). The vacuum 24 may vacuum the atomized cleaning medium 26 and debris 30.

Optionally, a plurality of air coupled ultrasonic devices 126 (e.g., the ultrasonic devices shown and described in FIGS. 10-12) may be located in relatively close proximity to the surface 16 of the object 18. For example, the ultrasonic devices 126 may be positioned generally opposite the location of the cleaning head 32 and the ultrasonic devices 20 (e.g., an opposing surface 150). The ultrasonic devices 126 may be connected to one or more ultrasonic device holding fixtures 132. The ultrasonic device holding fixtures 132 may provide for manual or electromechanical movement and positioning of the ultrasonic devices 126 relative to the object 18, such that the ultrasonic devices 126 may move alone with the cleaning head 32.

A plurality of ultrasonic devices 20 (e.g., an array of ultrasonic devices 20) may emit ultrasonic waves 28 directed toward the surface 16 and into the object 18. A plurality of ultrasonic devices 126 (e.g., an array of ultrasonic devices 126) may emit ultrasonic waves 128 toward the opposing surface 150 and into the object 18. The ultrasonic waves 28 and the ultrasonic waves 128 may be focused toward the surface 16 of the object 18 and interfere with each other about the cleaning zone 54 (FIG. 6) of the object 18. The interfering ultrasonic waves 28 and 128 may generates the longitudinal waves and/or shear waves in the object 18 and/or the plate waves and/or shear waves on the surface 16 of the object 18 (e.g., ultrasonic vibrations in the object 18) to atomize the cleaning medium 26 and debris 30 (e.g., debris particles retained by the cleaning medium 26). The vacuum 24 may vacuum the atomized cleaning medium 26 and debris 30.

Referring to FIG. 17, in another implementation, the cleaning head 32 may be mounted to a telescopic boom assembly 152. The cleaning head 32 (e.g., the cleaning head 32 shown and described in FIGS. 1-6) may include at least one cleaning medium dispenser 22 to deliver cleaning medium 26 to the surface 16 of the object 18, at least one air coupled ultrasonic device 20 to emit ultrasonic waves 28 to the surface 16 of the object 18 and at least one vacuum 24 to provide a vacuum airflow 50 to the surface 16 of the object 18.

The movable assembly 112 may be one or more cart assemblies 116 and the telescopic boom assembly 152. The cart assembly 116 may house the ultrasonic generator 40, the cleaning medium source 44 and the vacuum source 48. The cleaning head 32 may be functionally coupled to the cart assembly 116 by the supply line 82. For example, the ultrasonic supply line 42 may be electrically coupled to the ultrasonic devices 20, the cleaning medium supply line 46 may be fluidly coupled to the cleaning medium dispenser 22 and the vacuum supply line 52 may be fluidly coupled to the vacuum 24.

The telescopic boom assembly 152 may be configured to automatically or semi-automatically move and position the cleaning head 32 with respect to the surface 16 to be cleaned within the confined space 142. The telescopic boom assembly 152 may be rotatable and articulated. For example, the telescopic boom assembly 152 may include a riser stand 156 and at least one telescopic arm 154 movably connected to the riser stand 156. The cleaning head 32 may be connected to an end of the telescopic arm 154, for example at an end effector 160. An actuator 158 may automatically adjust the position of the cleaning head 32 by extending and/or retracting the telescopic arm 154.

During a cleaning operation, the telescopic arm 154 of the telescopic boom assembly 152 and the cleaning head 32 may be located within the confined space 142, for example introduced within the confined space 142 through the access port 144 in the object 18. The cleaning head 32 may be automatically or semi-automatically positioned in relative close proximity to the surface 16 of the object 18 to be cleaned, for example by actuating the telescopic arm 154 and/or the end effector 160.

A plurality of ultrasonic devices 20 (e.g., an array of ultrasonic devices 20) may emit ultrasonic waves 28, for example from the cleaning head 32, directed toward the surface 16 and into the object 18. The ultrasonic waves 28 may be focused toward the surface 16 of the object 18 and generate the longitudinal waves and/or shear waves in the object 18 and/or the plate waves and/or shear waves on the surface 16 of the object 18 (e.g., ultrasonic vibrations in the object 18) to atomize the cleaning medium 26 and debris 30 (e.g., debris particles retained by the cleaning medium 26). The vacuum 24 may vacuum the atomized cleaning medium 26 and debris 30.

Optionally, a plurality of air coupled ultrasonic devices 126 (e.g., the ultrasonic devices shown and described in FIGS. 10-12) may be located in relatively close proximity to the surface 16 of the object 18. For example, the ultrasonic devices 126 may be positioned generally opposite the location of the cleaning head 32 and the ultrasonic devices 20 (e.g., an opposing surface 150). The ultrasonic devices 126 may be connected to one or more ultrasonic device holding fixtures 132. The ultrasonic device holding fixtures 132 may provide for manual or electromechanical movement and positioning of the ultrasonic devices 126 relative to the object 18, such that the ultrasonic devices 126 may move along with the cleaning head 32.

A plurality of ultrasonic devices 20 (e.g., an array of ultrasonic devices 20) may emit ultrasonic waves 28 directed toward the surface 16 and into the object 18. A plurality of ultrasonic devices 126 (e.g., an array of ultrasonic devices 126) may emit ultrasonic waves 128 toward the opposing surface 150 and into the object 18. The ultrasonic waves 28 and the ultrasonic waves 128 may be focused toward the surface 16 of the object 18 and interfere with each other about the cleaning zone 54 (FIG. 1) of the object 18. The interfering ultrasonic waves 28 and 128 may generates the longitudinal waves and/or shear waves in the object 18 and/or the plate waves and/or shear waves on the surface 16 of the object 18 (e.g., ultrasonic vibrations in the object 18) to atomize the cleaning medium 26 and debris 30 (e.g., debris particles retained by the cleaning medium 26). The vacuum 24 may vacuum the atomized cleaning medium 26 and debris 30.

Thus, the disclosed system 10 may be utilized in a variety of different configurations dependent upon a given cleaning operation and type of object 18 being cleaned. For example, the object 18 and all of the ultrasonic devices (e.g., ultrasonic devices 58 and 126) may be stationary and the cleaning head 32 (e.g., including the cleaning medium dispenser 22 and the vacuum 24) may move in one or more directions (e.g., alongside the object 18 in the X and/or Y directions).

As another example, the object 18 and particular ultrasonic devices (e.g., ultrasonic devices 58 and 126) may be stationary and the cleaning head 32 (e.g., including the ultrasonic devices 20, the cleaning medium dispenser 22 and the vacuum 24) and certain ultrasonic devices (e.g., ultrasonic devices 126) may move in one or more directions (e.g., alongside the object 18 in the X and/or Y directions).

As another example, the object 18 may be stationary and the cleaning head 32 (e.g., including the ultrasonic devices 20, the cleaning medium dispenser 22 and the vacuum 24) and all of the ultrasonic devices (e.g., ultrasonic devices 58 and 126) may move in one or more directions (e.g., alongside the object 18 in the X and/or Y directions).

As another example, the object 18, the cleaning head 32 (e.g., including the ultrasonic devices 20, the cleaning medium dispenser 22 and the vacuum 24) and all of the ultrasonic devices (e.g., ultrasonic devices 58 and 126) may move one or more directions. As yet another example, the cleaning head 32 (e.g., including the ultrasonic devices 20, the cleaning medium dispenser 22 and the vacuum 24) and all of the ultrasonic devices (e.g., ultrasonic devices 58 and 126) may be stationary and the object 18 may move in one or more directions (e.g., alongside the cleaning head 32 and/or the ultrasonic devices in the X and/or Y directions).

The size, quantity, location, relative position, orientation angle, and distance from the surface 16 of the object 18 (e.g., the cleaning zone 54) may be considered when sizing and configuring the ultrasonic devices 20, 58 and 126 for a given cleaning operation. For example, a relatively small number of ultrasonic devices having high power may be used. As another example, a relatively large number of ultrasonic devices having low power may be used.

Figure 18:
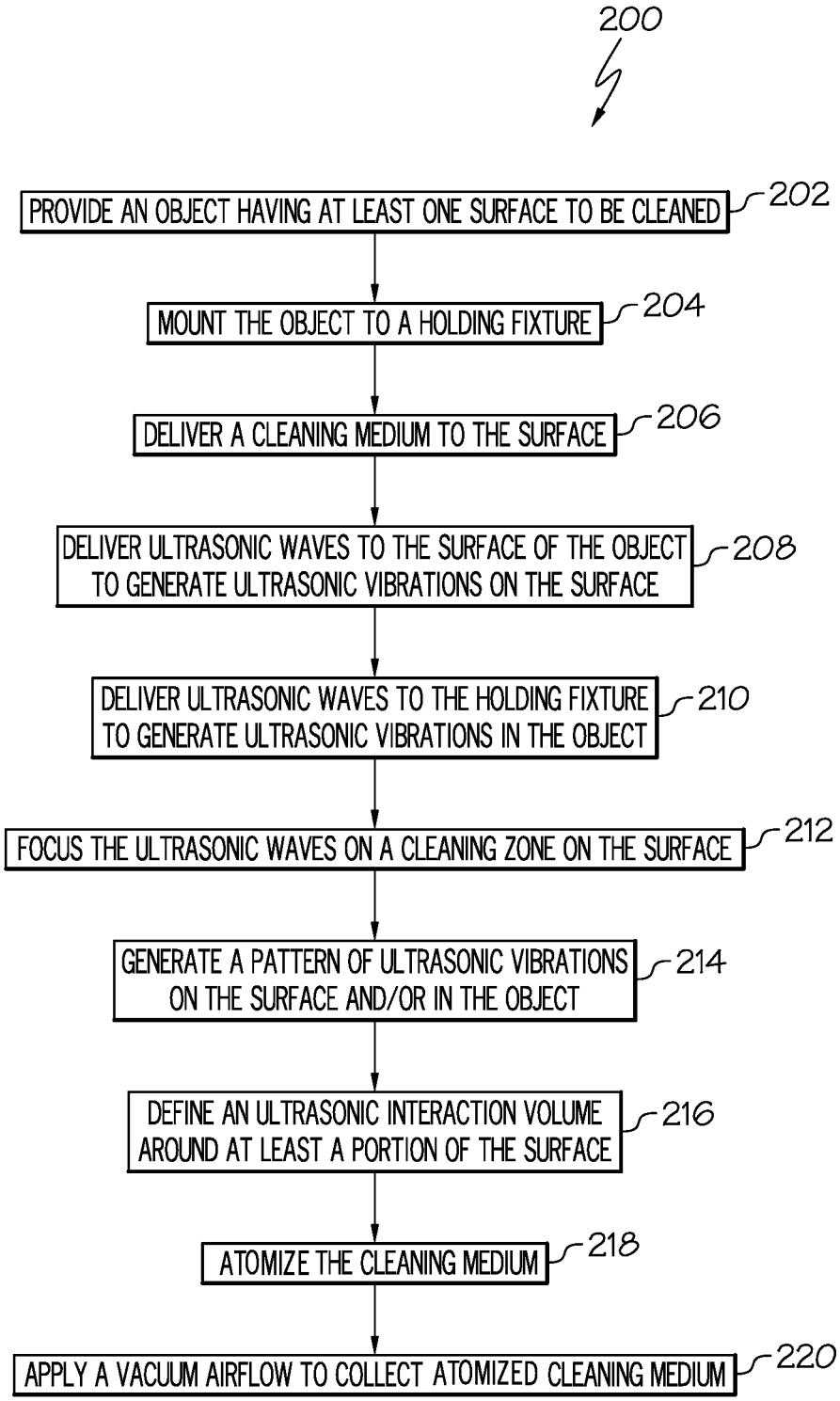
FIG. 18 is a flow diagram of one aspect of the disclosed method for surface cleaning.

Referring to FIG. 18, one aspect of the disclosed method, generally designated 200, for surface cleaning of an object may begin at block 202 by providing an object having at least one surface to be cleaned.

As shown at block 206, a cleaning medium (e.g., steam or hot water) may be delivered to the surface of the object. For example, the cleaning medium may be discharged from a cleaning medium dispenser. The cleaning medium may dislodge contaminants and debris disposed on the surface of the object.

As shown at block 208, ultrasonic waves may be delivered to the surface of the object. The ultrasonic waves may generate ultrasonic vibrations (e.g., in response to longitudinal waves, shear waves, surface waves and/or plate waves) on the surface of the object. The ultrasonic waves may be emitted by one or more ultrasonic devices. The ultrasonic devices may be air coupled to the object.

As shown at block 204, optionally, the object may be mounted to a holding fixture prior to the step of delivering the cleaning medium or delivering the ultrasonic waves to the surface of the object. The holding fixture may define an acoustically resonate system.

As shown at block 210, ultrasonic waves may be delivered to the holding fixture to generate ultrasonic vibrations in the object. The ultrasonic waves may be emitted by one or more ultrasonic devices. The ultrasonic devices may be air coupled to the holding fixture or physically coupled to the holding fixture.

As shown at block 212, the ultrasonic waves may be focused on a cleaning zone on the surface of the object. As shown at block 214, the focused waves may generate a pattern of ultrasonic vibrations on the surface of the object and/or in the object.

As shown at block 216, the pattern of ultrasonic vibrations may define an ultrasonic interaction volume around at least a portion of the surface of the object through interference of the ultrasonic waves.

As shown at block 218, atomizing the cleaning medium and any contaminants and debris collected within the cleaning medium in response to the ultrasonic vibrations on the surface of the object and/or in the object.

As shown at block 220, a vacuum airflow may be applied to the surface of the object to collect atomized cleaning medium and any contaminant and debris (e.g., particles of contaminants and debris) captured by the cleaning medium.

Accordingly, the disclosed system and method may be used to clean one or more surfaces of a large and/or complex object by combining ultrasonic vibrations (e.g., via focused ultrasonic waves), a cleaning medium (e.g., steam) and a vacuum airflow. A plurality of ultrasonic devices (e.g., an array of ultrasonic devices) may generate and emit directional ultrasonic waves (e.g., ultrasonic beams) that are electronically and mechanically focused on particular areas (e.g., a cleaning zone) on the surface of the object. Activating and tuning the ultrasonic devices by various electronic and mechanical means may create desired patterns of ultrasonic vibrations in and on the object to achieve the cleaning effect. As an example, positioning and focusing of the ultrasonic waves may be achieved through movement of various cleaning heads and/or holding fixtures equipped with the ultrasonic devices. Tuning of the ultrasonic devices may be achieved with the concept of parametric array.

Referring generally to FIGS. 1, 6 and 10, the various aspects of the disclosed system 10 for cleaning an object including a surface may include a cleaning medium dispenser 22 configured to deliver a cleaning medium 26 to the surface 16 of the object 18, wherein the cleaning medium 26 may dislodge and capture debris 30 from the surface, an ultrasonic device 20 configured to deliver ultrasonic waves to the object 18, wherein the ultrasonic waves 28 atomize the cleaning medium 26 and captured debris 30 from the surface, and a vacuum configured to provide a vacuum airflow, wherein the vacuum airflow collects atomized cleaning medium and captured debris.

In one aspect, the ultrasonic waves 28 may generate ultrasonic vibrations on the surface 16 of the object 18. The ultrasonic waves 28 may generate ultrasonic vibrations in the object 18. The ultrasonic waves 28 may include at least one of longitudinal waves, shear waves, surface waves and plate waves. The ultrasonic waves 28 may be focused to a cleaning zone 54 on the surface 16 of the object 18

In another aspect, the position of the cleaning medium dispenser 22, the ultrasonic device 20 and the vacuum 24 may be adjustable with respect to the surface 16 of the object 18. The cleaning medium dispenser 22, the ultrasonic device 20 and the vacuum may be mounted to a cleaning head 32. The cleaning head 32 may be mounted to a movable assembly 112, wherein the movable assembly 112 may position the cleaning head 32 relative to the surface 16.

In another aspect, the disclosed system 10 may include a holding fixture 56 configured to hold the object 18, wherein the holding fixture 56 defines an acoustically resonating system, and wherein the ultrasonic waves 28 generate ultrasonic vibrations in the object 18. The ultrasonic device 20 may be coupled to the holding fixture and the cleaning medium dispenser 22 and the vacuum 24 may be mounted to the cleaning head 32. The ultrasonic device 20 may be coupled to the holding fixture 56 and a position of the cleaning medium dispenser 22 and the vacuum 24 may be adjustable with respect to the object 18. The ultrasonic device 20 may be physically coupled to the holding fixture 56. The ultrasonic device 20 may be air coupled to at least one of the holding fixture 56 and the object 18.

In another aspect, the cleaning medium dispenser 22, the ultrasonic device 20 and the vacuum 24 may be mounted to the cleaning head 32. The holding fixture 56 may include a second ultrasonic device 58 configured to deliver second ultrasonic waves 62 through the holding fixture 56 and into the object 18. The ultrasonic waves 28 and the second ultrasonic waves 62 may generate ultrasonic vibrations in the object 18 to atomize the cleaning medium 26 from the surface 16. The holding fixture 56 may be a part of the object 18.

In another aspect, the disclosed system 10 may include a second ultrasonic device 58, 126 configured to deliver second ultrasonic waves 62, 128 to the object 18. The ultrasonic device 20 may be air coupled to the object 18. The second ultrasonic device 128 may be air coupled to the object 18. Interference of the ultrasonic waves 28 and the second ultrasonic waves 128 may define an ultrasonic interaction volume 140 around at least a portion of the surface 16.

In one aspect, the holding fixture 56 may be configured to hold the object 18. The holding fixture 56 may an acoustically resonating system. The ultrasonic waves 28 and the second ultrasonic waves 62 may generate ultrasonic vibrations in the object 18 to atomize the cleaning medium 26 from the surface 16. The second ultrasonic device 58 may be physically coupled to the holding fixture 56. The ultrasonic device 20 may be air coupled to at least one of the object 18 and the holding fixture 56.

In another aspect, the disclosed system 10 may include a plurality of ultrasonic devices 20, 58, 126 arranged in an acoustic array. The plurality of ultrasonic devices 20, 58, 126 may deliver ultrasonic waves 28, 62, 128 to the object 18. The ultrasonic waves 28, 62, 128 may generate a pattern of ultrasonic vibrations in the object 18. The acoustic array may include at least one of a parametric array and a phased array. The plurality of ultrasonic devices 20, 126 may be air coupled to the object 18.

In another aspect, the holding fixture 56 may be configured to hold the object 18. The holding fixture 56 may define an acoustically resonating system. At least a portion of a plurality of ultrasonic devices 58 may be physically coupled to the holding fixture 56. At least a portion of a plurality of ultrasonic devices 20, 126 may be air coupled to at least one of the holding fixture 56 and the object 18.

In another aspect, the cleaning medium 26 may disintegrate and dislodge the debris 30 from the surface. The ultrasonic waves may reduce adhesion between the surface 16 and the debris 30. The cleaning medium 26 may include a fluid. The fluid may include at least one of a liquid and a gas. The cleaning medium 26 may include at least one of steam, water, and an aqueous solution.

Referring generally to FIGS. 1, 6, 10 and 18, one aspect of the disclosed method 200 for cleaning an object including a surface may include the steps of: (1) delivering the cleaning medium 26 to the surface 16 of the object 18, (2) delivering ultrasonic waves 28, 62, 128 to the object 18 to atomize the cleaning medium 26, and (3) applying a vacuum airflow 50 to collect atomized cleaning medium 26. The ultrasonic waves 28, 62, 128 may generate ultrasonic vibrations in the object 18.

In another aspect, the disclosed method 200 may include the steps of: (4) mounting the object 18 to the holding fixture 56, wherein the holding fixture 56 may define an acoustically resonating system, and (5) delivering the ultrasonic waves 28, 62, 128 to at least one of the holding fixture 56 and the object 18 to generate ultrasonic vibrations in the object 18.

In another aspect, the disclosed method 200 may include the steps of: (6) focusing the ultrasonic waves 28, 62, 128 on the cleaning zone 54 on the surface 16 of the object 18, and (7) generating a pattern of ultrasonic vibrations in the object 18. The step of generating the pattern of ultrasonic vibrations may include defining an ultrasonic interaction volume 140 around at least a portion of the surface 16 through interference of the ultrasonic waves 28, 62, 128.

In another aspect, the cleaning medium 26 may disintegrate and dislodge debris 30 from the surface 16. The cleaning medium 26 may include at least one of a liquid and a gas. The ultrasonic waves 28, 62, 128 may reduce adhesion between the surface 16 and the debris 30.

Figure 19:
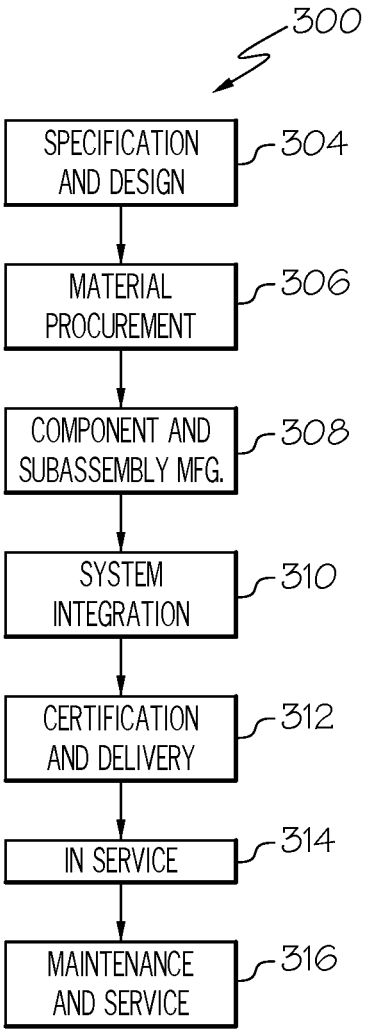
FIG. 19 is flow diagram of an aircraft production and service methodology.
Figure 20:
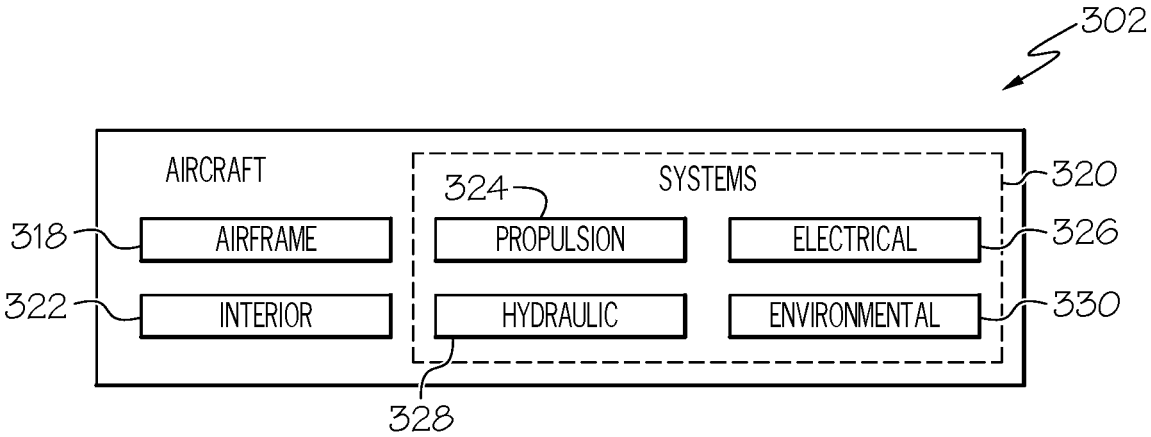
FIG. 20 is a block diagram of an aircraft.

Examples of the disclosure may be described in the context of an aircraft manufacturing and service method 300, as shown in FIG. 19, and an aircraft 302, as shown in FIG. 20. During pre-production, the aircraft manufacturing and service method 300 may include specification and design 304 of the aircraft 302 and material procurement 306. During production, component/subassembly manufacturing 308 and system integration 310 of the aircraft 302 takes place. Thereafter, the aircraft 302 may go through certification and delivery 312 in order to be placed in service 314. While in service by a customer, the aircraft 302 is scheduled for routine maintenance and service 316, which may also include modification, reconfiguration, refurbishment and the like.

Each of the processes of method 300 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 20, the aircraft 302 produced by example method 300 may include an airframe 318 with a plurality of systems 320 and an interior 322. Examples of the plurality of systems 320 may include one or more of a propulsion system 324, an electrical system 326, a hydraulic system 328, and an environmental system 330. Any number of other systems may be included. Although an aerospace example is shown, the principles of the disclosed system 10 and method 200 may be applied to other industries, such as the automotive industry.

Apparatus and methods embodied herein may be employed during any one or more of the stages of the production and service method 300. For example, components or subassemblies corresponding to component/subassembly manufacturing 308, system integration 310, and or maintenance and service 316 may be fabricated or manufactured using the disclosed system 10 (FIGS. 1, 6 and 10) and method 200 (FIG. 18). Also, one or more apparatus examples, method examples, or a combination thereof may be utilized during component/subassembly manufacturing 308 and/or system integration 310, for example, by substantially expediting assembly of or reducing the cost of an aircraft 302, such as the airframe 318 and/or the interior 322. Similarly, one or more of apparatus examples, method examples, or a combination thereof may be utilized while the aircraft 302 is in service, for example and without limitation, to maintenance and service 316.

Although various aspects of the disclosed system and method have been shown and described, modifications may occur to those skilled in the art upon reading the specification. The present application includes such modifications and is limited only by the scope of the claims.

What is claimed is:

1. A method for cleaning an object comprising a surface, said method comprising:

delivering a vaporized cleaning medium from a nozzle, which is situated inside of a cleaning chamber of a cleaning head, to said surface to dislodge at least a portion of debris from said surface via impingement of said vaporized cleaning medium with said surface;

condensing said vaporized cleaning medium on said surface to form a condensed cleaning medium, wherein at least said portion of debris, dislodged from said surface, is captured by said condensed cleaning medium on said surface;

delivering first ultrasonic waves from a first ultrasonic transducer, which is situated inside of said cleaning chamber, to said object and to said condensed cleaning medium on said surface;

delivering second ultrasonic waves from a second ultrasonic transducer, which is situated outside of said cleaning chamber, to said object and to said condensed cleaning medium on said surface;

generating ultrasonic vibrations on said surface in response to said first ultrasonic waves and said second ultrasonic waves to dislodge at least another portion of debris from said surface, wherein at least said another portion of debris is captured by said condensed cleaning medium on said surface; and generating ultrasonic vibrations in said condensed cleaning medium in response to said first ultrasonic waves and said second ultrasonic waves to atomize said condensed cleaning medium and captured debris, contained within said condensed cleaning medium.

2. The method of claim 1, further comprising collecting atomized cleaning medium and said captured debris, contained within said atomized cleaning medium, using a vacuum, fluidly coupled to said cleaning chamber.

3. The method of claim 1, further comprising tuning said first ultrasonic waves to generate at least one of longitudinal waves and shear waves in said object.

4. The method of claim 1, further comprising mounting said object to a holding fixture.

5. The method of claim 1, wherein delivering said first ultrasonic waves to said object and to said condensed cleaning medium is performed via non-contact transmission.

6. The method of claim 4, further comprising:

delivering third ultrasonic waves from a third ultrasonic transducer, which is mounted to said holding fixture, to said object and to said condensed cleaning medium on said surface;

generating said ultrasonic vibrations on said surface in response to said first ultrasonic waves, said second ultrasonic waves, and said third ultrasonic waves to dislodge at least said another portion of debris from said surface, wherein at least said another portion of debris is captured by said condensed cleaning medium on said surface; and generating said ultrasonic vibrations in said condensed cleaning medium in response to said first ultrasonic waves, said second ultrasonic waves, and said third ultrasonic waves to atomize said condensed cleaning medium and said captured debris, contained within said condensed cleaning medium.

7. The method of claim 1, wherein said vaporized cleaning medium is steam.

8. The method of claim 7, wherein said condensed cleaning medium is water.

9. The method of claim 1, further comprising selectively positioning said cleaning head relative to said surface of said object.

10. The method of claim 1, further comprising tuning one of said first ultrasonic waves or said second ultrasonic waves to a frequency ranging from 1 Hz to 20 kHz.

11. The method of claim 1, wherein said first ultrasonic waves and said second ultrasonic waves are different in at least one of wave form and frequency.

12. The method of claim 5, wherein said non-contact transmission utilizes air as a coupling medium.

13. The method of claim 6, wherein said third ultrasonic waves are different than at least one of said first ultrasonic waves and said second ultrasonic waves in at least one of wave form and frequency.

14. The method of claim 6, wherein:

said third ultrasonic transducer is spaced away from said surface of said object; and delivering said third ultrasonic waves to said object and to said condensed cleaning medium is performed via non-contact transmission.

15. The method of claim 14, further comprising selectively positioning the third ultrasonic transducer relative to said surface of said object.

16. The method of claim 6, wherein delivering said third ultrasonic waves to said object and to said condensed cleaning medium is performed via contact transmission.

17. The method of claim 6, wherein:

said holding fixture is in contact with at least a portion of said object;

said third ultrasonic transducer is in contact with said holding fixture; and delivering said third ultrasonic waves to said object and to said condensed cleaning medium on said surface comprises transferring said third ultrasonic waves through said holding fixture to said object.

18. The method of claim 3, further comprising tuning said second ultrasonic waves to generate at least one of surface waves and plate waves on said surface of said object.

19. The method of claim 5, wherein delivering said second ultrasonic waves to said object and to said condensed cleaning medium is performed via said non-contact transmission.

20. The method of claim 1, further comprising tuning one of said first ultrasonic waves or said second ultrasonic waves to a frequency ranging from 1 MHz to 500 MHz.

* * * * *